US005234662A

United States Patent [19]

Balmuth et al.

[11] Patent Number: 5,234,662

[45] Date of Patent: Aug. 10, 1993

[54] LOW DENSITY ALUMINUM LITHIUM ALLOY

[75] Inventors: Edward S. Balmuth, Azle, Tex.; David J. Chellman, Los Angeles, Calif.; Frank W. Gayle, Gaithersburg, Md.; Richard A. Rainen, Sun Valley, Calif.; Michael H. Skillingberg, Richmond, Va.

[73] Assignee: Reynolds Metals Company, Richmond, Va.

[21] Appl. No.: 655,629

[22] Filed: Feb. 15, 1991

[51] Int. Cl.[5] ..... C22C 21/12

[52] U.S. Cl. ..... 420/529; 148/416; 148/417; 148/438; 148/439; 420/533; 420/535

[58] Field of Search ..... 420/529, 533, 535; 148/439, 438, 416, 417, 11.5 A, 700, 694

[56] References Cited

U.S. PATENT DOCUMENTS 4,897,126 1/1990 Bretz et al. ..... 148/417

5,066,342 11/1991 Rioja et al. ..... 148/416

*Primary Examiner*—R. Dean

*Assistant Examiner*—Robert R. Koehler

*Attorney, Agent, or Firm*—Alan M. Biddison

[57] ABSTRACT

Aluminum based alloy primarily for use in aircraft and aerospace components consists essentially of the composition: 2.60 to 3.30 weight percent copper, 0.0 to 0.50 weight percent manganese, 1.30 to 1.65 weight percent lithium, 0.0 to 1.8 percent magnesium, and from 0.0 to 1.5 weight percent of grain refinement elements selected from the group consisting of zirconium, and chromium. Up to about 0.5 wt. % zinc and up to about 1.5 wt. % titanium may also be present. Minor impurities may also be present. These alloys exhibit an improved combination of characteristics including low density, high strength, high corrosion resistance and good fracture toughness.

27 Claims, 20 Drawing Sheets

LOW DENSITY ALUMINUM LITHIUM ALLOY

FIELD OF THE INVENTION

This invention relates to aluminum based alloy products and more particularly relates to lithium containing alloy products having improved properties.

BACKGROUND OF THE INVENTION

In many industries, such as the aerospace industry, one of the effective ways to reduce weight of the aircraft is to reduce the density of aluminum alloys used in the aircraft's construction. It is known in the art that aluminum alloy densities may be reduced by the addition of lithium but the addition of lithium to aluminum based alloys also raises other problems. For example, the addition of lithium to aluminum alloys may result in a decrease in ductility and fracture toughness. For use as aircraft structural parts, it is obviously imperative that any alloy have excellent fracture toughness and strength properties. It will be appreciated that both high strength and high fracture toughness are difficult to obtain in conventional alloys normally used in aircraft applications. See, for example, the publication by J. T. Staley entitled "Microstructure and Toughness of High Strength Aluminum Alloy, Properties Related to Fracture Toughness," ASTM STP 605, American Society for Testing and Materials, 1976, pages 71–103, which suggests generally that for sheet formed from the Alloy AA2024, toughness decreases as strength increases. The same has been observed to be true for the Alloy AA7050. A more desirable alloy would permit increased strength with only minimal or no decrease in fracture toughness or would permit processing steps wherein the fracture toughness was controlled as the strength was increased in order to provide a more desirable combination of strength and fracture toughness. Such alloys would find a widespread use in the aerospace industry where low density and high strength together with fracture toughness are highly desired.

Aluminum alloys are currently applied in high performance aircraft in peak strength or over aged heat treat conditions. They do not show degradation in fatigue, fracture or corrosion properties with exposure to thermal cycles usually encountered in parts such as bulkheads located near inlets and engine bays. Commercially available aluminum-lithium alloys such as AA2090, AA2091 and AA8090, have demonstrated a good combination of strength and fracture toughness but only in underaged conditions. In these alloys, fracture toughness is at a minimum in the peak strength condition and does not increase with overaging as with conventional alloys. Thus, the alloys are considered unstable with respect to thermal exposure. Short transverse fracture toughness for even an underaged condition, typically sixteen ksi $\sqrt{in}$ in AA8090, is well below minimum requirements for conventional alloys and considered to be too low for most applications. Also, like Alloy AA2124, the underaged conditions of Alloy AA2090 have demonstrated susceptibility to stress corrosion cracking (SCC) while the peak strength condition is resistent to stress corrosion cracking. Alloy AA2024 is an aluminum based alloy containing 3.8–4.9 weight percent copper, 1.2–1.8 weight percent magnesium, 0.30–0.9 weight percent manganese and a nominal copper to magnesium atomic ratio of 1.1 with a density of 0.101 pounds per cubic inch and a peak tensile yield strength (TYS) of 67 ksi. Alloy AA2090 is an aluminum based alloy containing 1.9–2.6 weight percent lithium, 2.4–3.0 weight percent copper, 0.25 maximum weight percent magnesium, 0.05 maximum weight percent manganese, with a nominal density of 0.0940 pounds per cubic inch and a TYS of 71 ksi. Alloy AA8090 is an aluminum based alloy containing 2.2–2.7 weight percent lithium, 1.0–1.6 weight percent copper, 0.6–1.3 weight percent magnesium, a maximum of 0.10 weight percent manganese, a maximum of 0.10 weight percent chromium, a maximum of 0.25 weight percent zinc, a maximum of 0.10 weight percent titanium and 0.04–0.16 weight percent zirconium, with a copper to magnesium atomic ratio of 0.7, a nominal density of 0.092 pounds per cubic inch and a TYS of 59 ksi. All percentages are weight percentages unless otherwise indicated.

There are many disclosures in the prior art of aluminum based alloys which contain lithium, copper and sometimes magnesium and manganese. Thus, U.S. Pat. No. 4,840,682 discloses in column 3 a table listing aluminum alloys which contain varying amounts of lithium, magnesium, copper, zirconium, manganese and minor amounts of other materials. In the actual example in this patent, the alloy contains 2.4 percent lithium, 1 percent magnesium, 1.3 percent copper and 0.15 percent zirconium, with the balance aluminum.

U.S. Pat. No. 4,889,569 discloses in a table in column 3 alloys of various compositions. In the actual patent examples, lithium appears to always be 2.0 percent and copper is 2.2 percent.

French Patent No. 2,561,261, EPO 158571 and U.S. Pat. No. 4,752,343, which appear to be directed to the same alloys, disclose alloys which contain varying amounts of lithium, copper, magnesium, iron, silicon and other elements. Generally, lithium is said to range from 1.7 to 2.9 percent, copper from 1.5 to 3.4 percent and magnesium from 1.2 to 2.7 percent but with limitations on the magnesium/copper ratio.

German Patent No. 3,346,882 and British 2,134,929 show at Table 1 a series of aluminum based lithium alloys which contain copper, magnesium and other ingredients.

U.S. Pat. No. 4,648,943 discloses an aluminum based alloy wrought product wherein, in the working examples, the aluminum alloy contains 2.0 percent lithium, 2.7 percent copper, 0.65 percent magnesium and 0.12 percent zirconium.

U.S. Pat. No. 4,636,357 discloses an aluminum alloy in which the lithium component ranges from 2.2 to 3.0 percent with a small amount of copper but a substantial amount of zinc.

U.S. Pat. No. 4,624,717 discloses an aluminum based alloy wherein the lithium component is about 2.3 to 2.9 percent and the copper component is 1.6 to 2.4 percent.

DISCLOSURE OF THE INVENTION

It is accordingly one object of this invention to provide a low density aluminum-lithium alloy which provides an improved combination of strength, corrosion resistance, fatigue resistance and fracture toughness properties.

A further object of the invention is to provide a low density, high modulus aluminum-lithium alloy which has an improved combination of strength, corrosion resistance and fracture toughness properties which makes the alloy especially useful for aerospace and aircraft components.

A still further object of the present invention is to provide an aluminum-lithium alloy which has improved strength, corrosion resistance, and fracture toughness properties, while demonstrating resistance to stress corrosion cracking.

An even further object of the present invention is to provide aluminum products such as plate, sheet, ingots and aerospace and aircraft components, formed from the improved alloy of this invention.

In satisfaction of the foregoing objects and advantages, there is provided by this invention an improved aluminum lithium alloy which contains 1.30 to 1.65 percent lithium, 2.60 to 3.30 percent copper, 0.0 to 0.50 percent manganese, 0.0 to 1.40 percent magnesium, the balance aluminum, together with minor amounts of other elements for grain refinement and other properties including from 0.0 to 1.5 weight percent of grain refinement elements selected from the group consisting of zirconium, titanium and chromium. In a variation of the foregoing, the magnesium level can be as high as 1.8 percent. In another variation, the magnesium level can be as high as 2.0 percent.

Also provided by the present invention are aerospace and aircraft components, alloys in plate, sheet or extrusion form and ingots, formed from an aluminum lithium alloy containing 1.30 to 1.60 percent lithium, 2.60 to 3.30 percent copper, 0.0 to 0.50 percent manganese, 0.0 to 1.40 percent magnesium, the balance aluminum, and minor amounts of grain refining elements, and the variations on said alloy.

BRIEF DESCRIPTION OF THE DRAWINGS

Reference is now made to the drawings accompanying the invention wherein.

DESCRIPTION OF PREFERRED EMBODIMENTS

Figure 1:
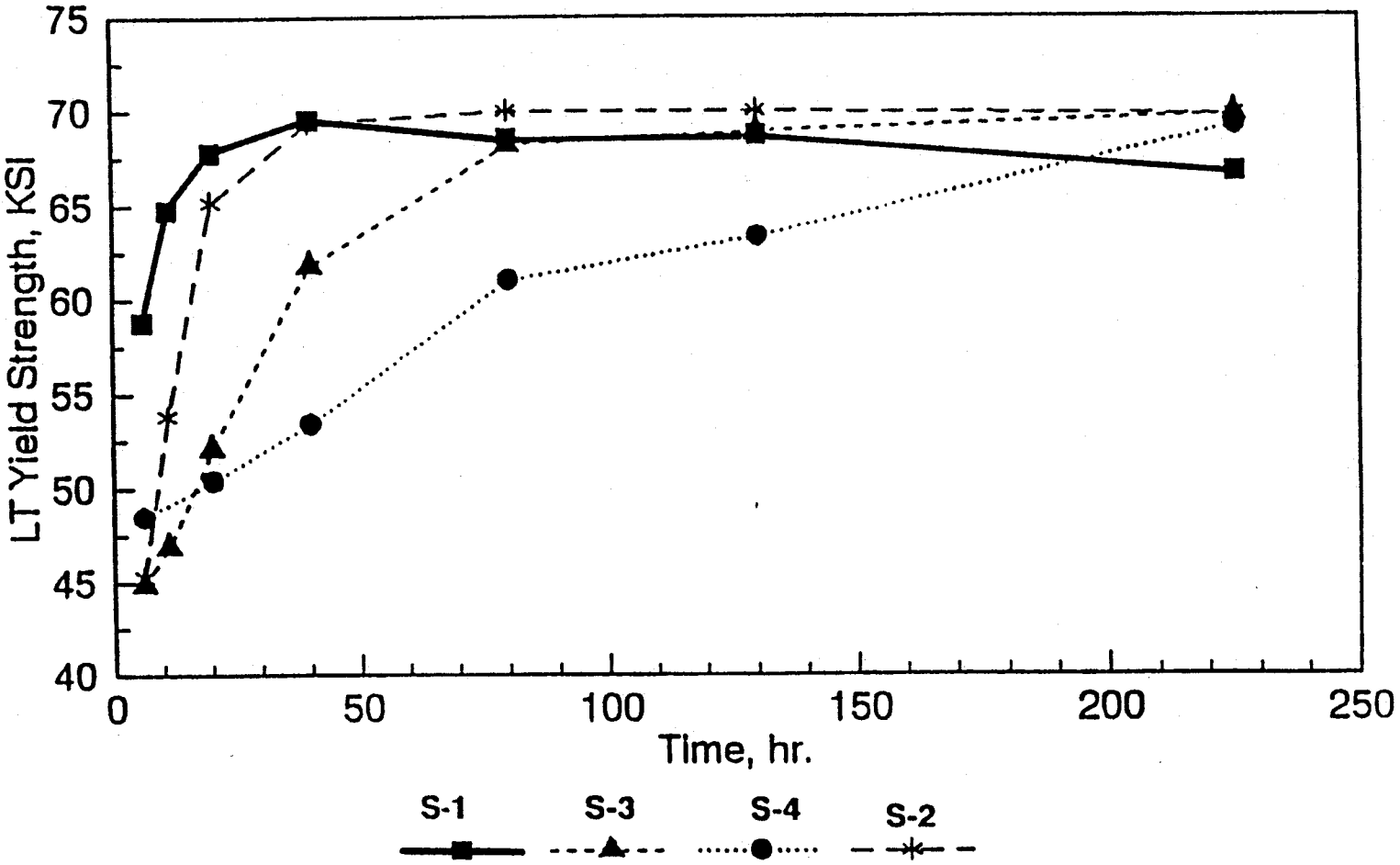
FIGS. 1 through FIG. 5 are graphs illustrating aging behavior under various conditions for alloys prepared and tested in Example 1.
Figure 2:
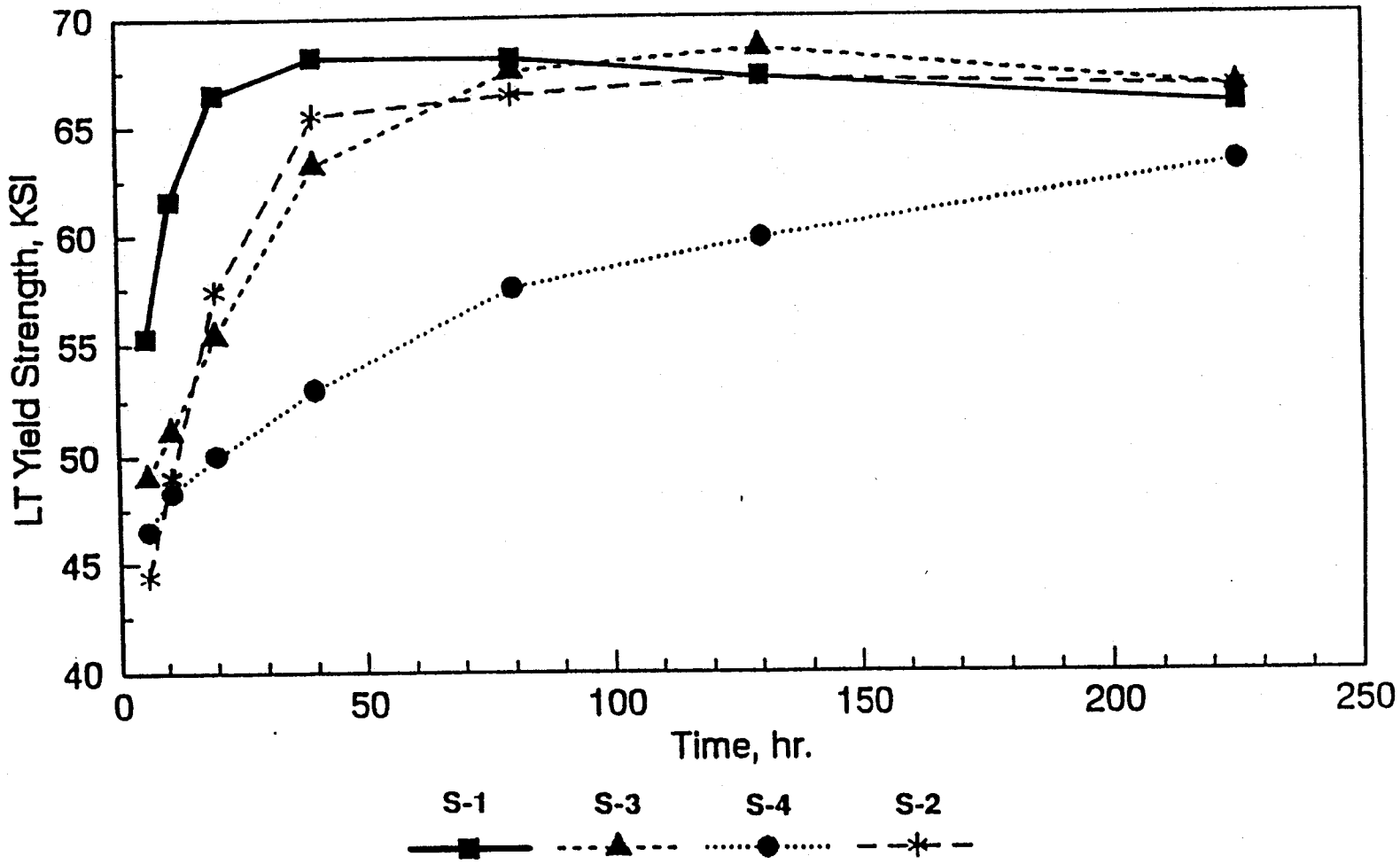
Figure 3:
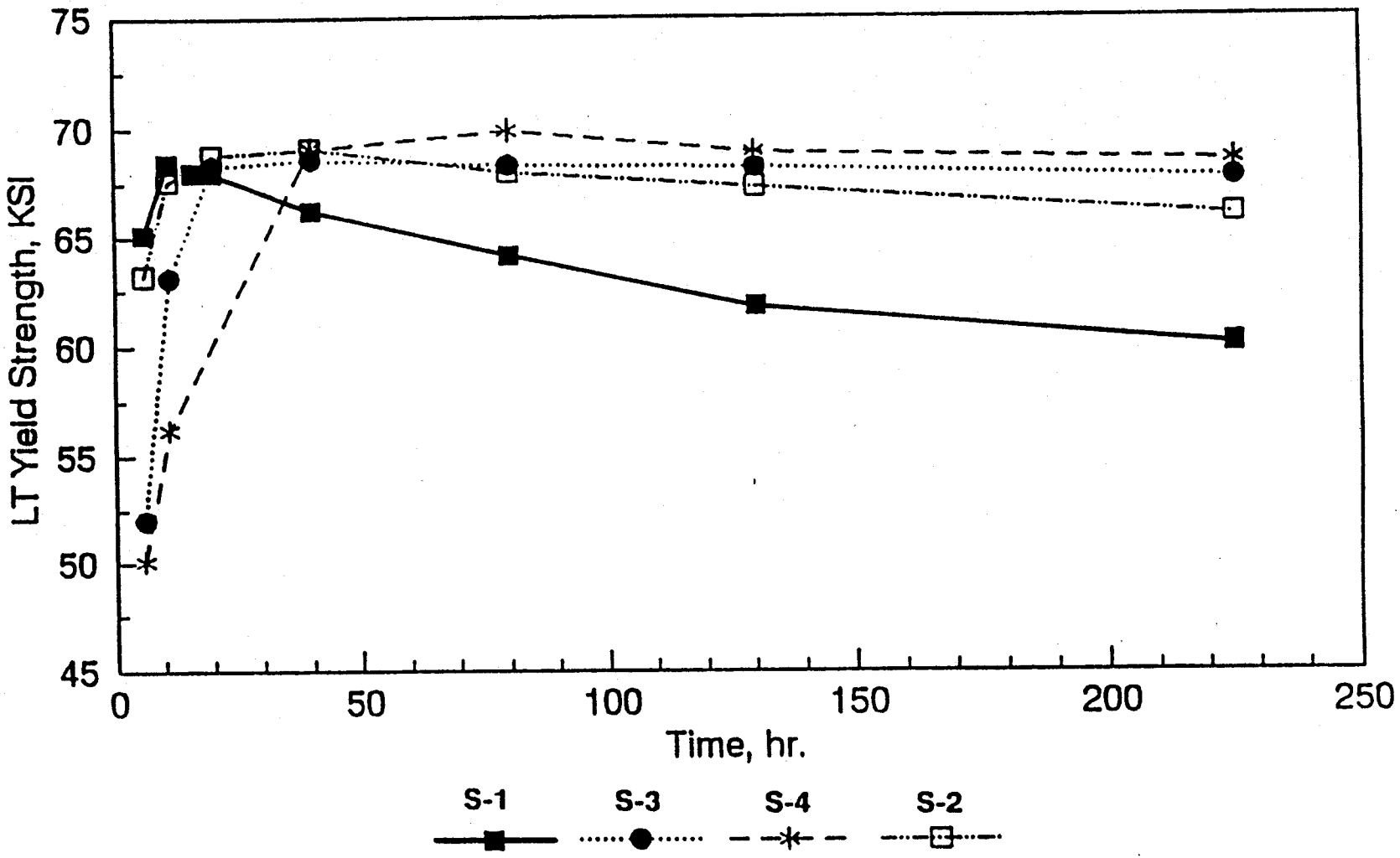
Figure 4:
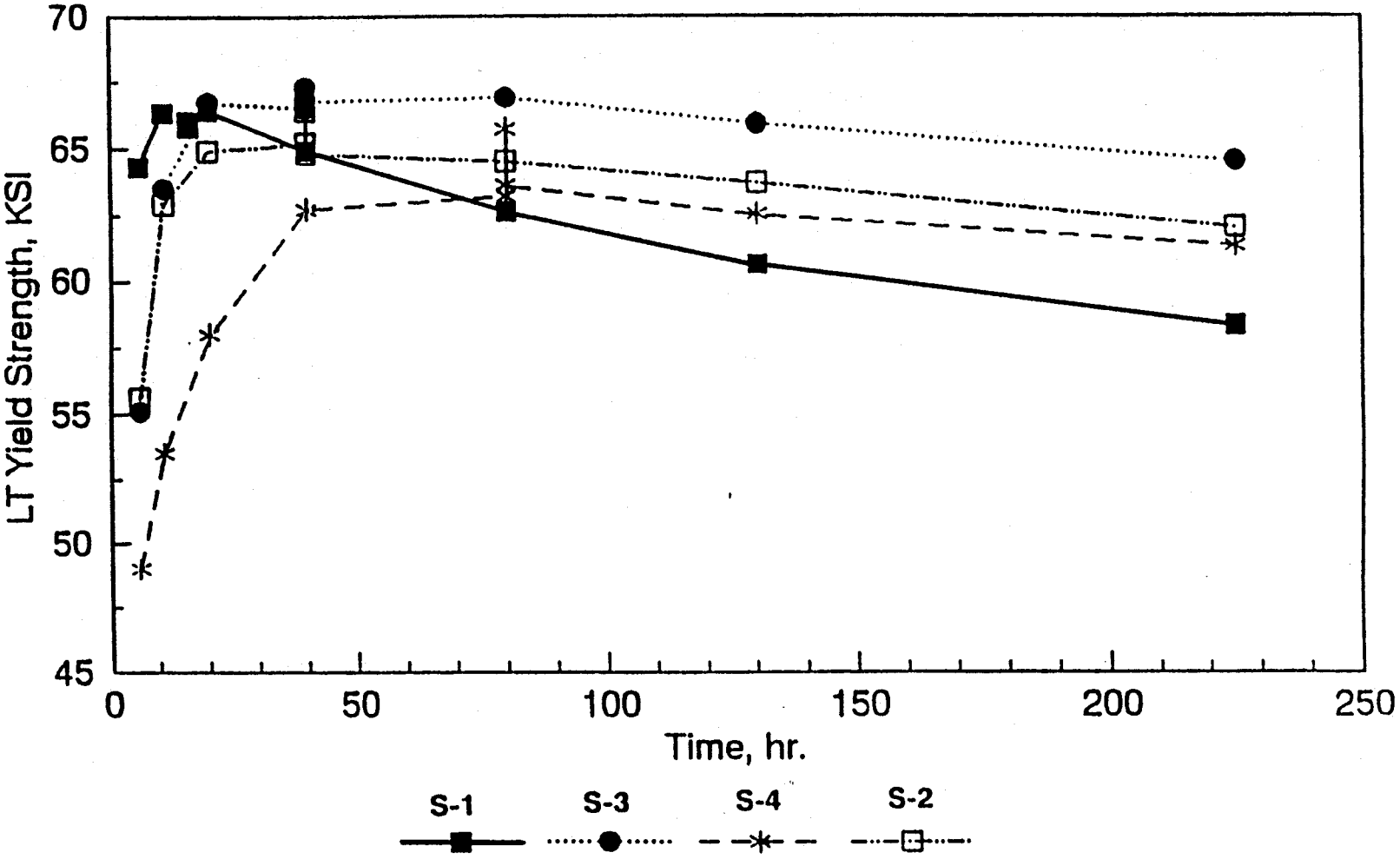

According to the present invention, it has been discovered that a selective class of aluminum based alloys which contain specific and critical amounts of lithium, copper and preferably manganese and optionally magnesium and minor amounts of grain refining elements, provides an excellent low density, high strength alloy for use in aerospace and high performance aircraft or other areas where low density, high strength and high fracture toughness are required. The aluminum alloys according to the present invention contain the following components:

TABLE 1

| COMPONENT | WEIGHT PERCENT |
|---|---|
| copper | 2.50 to 3.30 |
| manganese | 0.0 to 0.50 |
| lithium | 1.20 to 1.65 |
| magnesium | 0.0 to 1.80 |
| aluminum | Balance |

In one variation of the compositions set forth in Table I, the magnesium is in the range of 0.0 to 0.25 percent. In another variation, the magnesium is in the range of 0.25 to 0.8 percent. In still another variation, the magnesium is in the range of 0.8 to 1.8 percent, preferably 1.2 to 1.8 percent.

The composition may also contain minor amounts of grain refinement elements such as zirconium, chromium and/or titanium, particularly from 0.05 up to 0.30 weight percent zirconium, from 0.05 up to 0.50 weight percent chromium, from 0.001 up to 0.30 weight percent titanium. When more than one of these elements is added, the combined range can be from 0.05 up to 0.60 weight percent. The composition also may include minor amounts of impurities such as silicon, iron, and zinc up to 0.5 wt. % of the alloy.

The composition, in one embodiment, also has a copper to magnesium ratio of 0.50:1.0 to 2.30:1.0 and a density of 0.090 to 0.097 lb/in$^3$, more preferably a density between 0.094 to 0.096 lb/in$^3$. It will be appreciated that the Cu to Mg ratio will be quite higher in the low magnesium embodiments of the invention and could approach infinity in the embodiments without magnesium. These amounts of components, especially lithium, copper and manganese, are critical in providing aluminum based alloys which have the necessary characteristics to not show degradation in fatigue, fracture or corrosion properties, on exposure to thermal cycles usually encountered in aircraft components. The aluminum alloy of this invention is a low density alloy which exhibits excellent fatigue crack growth rates and appears to be superior to all other known high strength aluminum alloys.

It is recognized that certain prior patents and publications contain broad disclosures of aluminum based alloys which contain the components of the alloy of this invention and, in some cases, set forth broad ranges of components which appear to overlap with the components of the alloy of the invention. However, these prior art disclosures in their specific embodiments, i.e., alloys actually produced, do not show that there was known in the prior art any alloy which has the critical combination of the alloying elements of the claimed invention. Applicants have discovered that the amounts of each of the alloying components of this aluminum based alloy are critical and essential to provide an aluminum based alloy which has the excellent high strength and low density characteristics of the alloy of this invention. It was unexpectedly discovered, according to this invention, that the combination of copper, lithium, magnesium and manganese components in the amounts stated above when processed to components such as plate, have good combinations of low density, strength, toughness, fatigue resistance and corrosion resistance. This combination also exists in the short transverse (ST) direction. The alloys also show good property stability at elevated temperatures, for example, in the range of 360° F.

A more preferred alloy within the scope of the composition of the present invention contains 3.0 weight percent copper, 0.30 weight percent manganese, 1.60 weight percent lithium, and preferably 0.05 to 0.15 weight percent zirconium, and the balance aluminum and incidental impurities. This composition may also contain minor amounts of other elements such as titanium or chromium for grain refinement or for formation of dispersoids which can affect mechanical properties.

In the present invention, lithium is an essential element since it provides a significant decrease in density while improving tensile and yield strengths, elastic modulus and fatigue crack growth resistance. The combination of lithium with the other elements permits working of the aluminum alloy products to provide improved combinations of strength and fracture toughness. The copper is present to increase strength and to balance the lithium by reducing the loss in fracture toughness at higher strength levels. Thus, the combination of the lithium and the copper within the ranges set forth, together with the other alloying elements, provides the combination of low density, good toughness and strength.

In preparation of products using the alloy composition of this invention, the specific procedures set forth herein should be followed to provide the necessary and desirable characteristics of strength fracture toughness and low density. The alloy is preferably provided as an ingot by techniques currently known in the art for fabrication into a suitable wrought product. Ingots or billets may be preliminary worked or shaped to provide suitable stock for subsequent working operations. Prior to the principal working operation, the alloy stock is preferably subjected to stress relieving, sawing and homogenization, preferably at metal temperatures in the range of 900° to 1060° F. for a sufficient period of time to dissolve the soluble elements and homogenize the internal structure of the metal. A preferred homogenization residence time is in the range of one hour to thirty hours, while longer times do not normally adversely affect the product. In addition, homogenization is believed to precipitate dispersoids to help control and refine the final grain structure. Further, homogenization can be at either one temperature or at multiple steps utilizing several temperatures.

After homogenization, the metal can be rolled or extruded or otherwise worked to produce stock such as sheet, plate or extrusions or other stock suitable for shaping into the end product.

After homogenization, the alloy is hot worked, for example by rolling, to form a product. The product is then solution heat treated from less than an hour to several hours at a temperature of from around 930° F. to about 1030° F.

To further provide increased strength and fracture toughness in the final product, it is usually also necessary to rapidly quench the product after solution heat treating to prevent or minimize uncontrolled precipitation of strengthening phases in the alloy. After the metal has been quenched to a temperature of about 200° F., it may then be air cooled. Depending on procedures, it may be possible to omit some of these treating steps while other steps known to the art may also be included, such as stretching. Stretching is known in the art as a step applied after solution heat treatment and quenching to provide more uniform distribution of the lithium containing metastable precipitates after artificial aging. Additionally, press quenching could be used with extrusions.

After the alloy products have been worked, they may be artificially aged to provide an increased combination of fracture toughness and strength and this can be achieved by heating the shaped product to a temperature in the range of 150° to 400° F. for a sufficient period of time to further increase the yield strength.

On being processed into artificially aged plate, products according to the invention exhibit a long transverse UTS of 70.0–75.0 ksi, a TYS of 63.0–70.0 ksi, and elongation of 7.0–11.5% in the transverse direction. Longitudinally, the products exhibit a UTS of 68.0–74.0 ksi, a TYS of 64.0–71.5 ksi, and elongation of 6.0–10.5%.

Alloys according to the present invention, when subjected to spectrum fatigue testing, in S-L, L-T, T-L and 45° (to the rolling direction) directions, showed surprisingly improved resistance to fatigue crack growth as compared with conventional AA2124, AA7050 and AA7475 alloys.

The following examples are presented to illustrate the invention but it is not be considered as limited thereto. In these examples and throughout this specification, parts are by weight unless otherwise indicated. Also, compositions include normal impurities, such as silicon, iron, and zinc.

EXAMPLE 1

Alloy Selection

Four Al-Cu-Li-Mg-Zr alloys and one Al-Cu-Li-Mn-Zr alloy were produced which have approximately 4–7% lower density as compared to the alloy AA2124 and which have a peak yield strength of approximately 65 ksi based on a somewhat limited regression analysis. The alloys included a range of Cu to Mg ratios varying from infinity (Mg free) to 0.3. Manganese was added to the Mg free alloy to improve elevated temperature stability of mechanical properties. Table 2 lists the alloys selected, the Cu to Mg ratios and calculated densities and yield strengths.

TABLE 2

ALLOY COMPOSITIONS AND CALCULATED PROPERTIES

| Sample | Wt % Cu | Wt % Mg | Wt % Li | Wt % Mn | Cu/Mg At % | Calc. Dens. lb/in3 | Calc. YS KSI |
|---|---|---|---|---|---|---|---|
| S-1 | 3.0 | 0.0 | 1.6 | 0.3 | Infinity | .0958 | 64 |
| S-2 | 2.8 | 0.7 | 1.5 | 0.0 | 1.5 | .0957 | 64 |
| S-3 | 2.8 | 1.0 | 1.4 | 0.0 | 1.1 | .0959 | 64 |
| S-4 | 2.8 | 1.5 | 1.3 | 0.0 | 0.7 | .0960 | 65 |
| S-5 | 1.8 | 2.3 | 1.6 | 0.0 | 0.3 | .0930 | 62 |

Ti = .02–.03
Zr = .12

Casting and Homogenization

The alloys were DC cast as 8"×16" 350-pound ingots. The actual compositions of the ingots and their number designations are given in Table 3. The ingots were stress relieved prior to being sawed into sections for homogenizing and rolling. One quarter of each ingot was homogenized using the following two-step practice: 1) Heat 50° F./hour to 910° F., 2) Hold 910° F. for 4 hours, 3) Heat 50° F./hour to 1000° F., 0) Hold at 1000° F. for 24 hours and 5) Fan cool to room temperature. After further processing this metal was used to establish aging curves.

TABLE 3

RESULTS OF CHEMICAL ANALYSES OF INGOTS

| S. No. | Si | Fe | Cu | Mn | Mg | Zr | Li |
|---|---|---|---|---|---|---|---|
| S-1 | 0.04 | 0.06 | 2.99 | .26 | .005 | 0.11 | 1.61 |
| S-2 | 0.04 | 0.05 | 2.72 | <.01 | .67 | 0.12 | 1.49 |
| S-3 | 0.04 | 0.06 | 2.82 | <.01 | 1.00 | 0.12 | 1.41 |
| S-4 | 0.04 | 0.05 | 2.75 | <.01 | 1.47 | 0.12 | 1.28 |
| S-5 | 0.05 | 0.05 | 1.72 | <.01 | 2.21 | 0.12 | 1.56 |

Ti = .02-.03
Values given in Wt. %

After DSC analyses of as-cast ingot samples was performed, a second quarter of each ingot was homogenized using a higher temperature, longer time first step practice. The Mg-free (S-1) and the highest Mg level (S-5) alloys received a first step practice of 12 hours at 970° F. plus 24 hours at 1000° F., and the three intermediate Mg level alloys (S-2, 3 and 4) received a first step practice of 16 hours at 950° F. plus 24 hours at 1000° F. All remaining evaluations were performed on metal which had been processed using the second, higher temperature homogenization practice.

Rolling

After the original 910°/1000° F. homogenizing practice, the ingot sections were machined into rolling blocks (two per alloy) approximately 3"×7"×14". The blocks were heated to 900° F. and cross rolled ~50% with each rolling pass reducing the block thickness by approximately ⅛". The blocks were then reheated to 900° F. and straight rolled to 0.6" with reheats when the temperature dropped below 700° F. The high Mg alloy blocks (S-5) cracked during rolling and therefore had to be scrapped. The remaining four alloys will be referred to as Group I.

From each of the five alloys two additional blocks, which had received the higher temperature homogenization, were rolled using the same practice as the earlier material. All five alloys were successfully rolled and will be referred to as Group II.

Two alloys (Mg free S-1) and (1.5% Mg S-4) were also rolled separately. A single block 5.75"×11"×14" of each of the two alloys was preheated to 800° F., cross rolled to 3.0", cooled to room temperature, reheated to 800° F. and straight rolled to 1.27". These plates will be referred to as Group III.

| | Homogenization | Gauge, In. Starting | Final |
|---|---|---|---|
| Group I | 4h/910° F. + 24h/1000° F. (S-1, S-2, S-3, S-4) | 3 | 0.6 |
| Group II | 12h/970° F. + 24h/1000° F. (S-1, S-5) | 3 | 0.6 |
| | (16h/950° F. + 24h/1000° F. (S-2, S-3, S-4) | 3 | 0.6 |
| Group III | 12h/970° F. + 24h/1000° F. (S-1) | 5.75 | 1.27 |
| | 16h/950° F. + 24h/1000° F. (S-4) | 5.75 | 1.27 |

Solution Heat Treating and Acing

One plate from each of the four alloys which were successfully rolled in Group I was sawed longitudinally into two sections and was then solution heat treated for one hour at 1000° F. One piece of each alloy was quenched into cold water, and the remaining section of each plate was quenched into 200° F. water to simulate the quench rate at the center of a 5–6" plate quenched in cold water. The plates were all stretched 4–6% within approximately one hour of quenching.

In order to develop aging curves, transverse tensile specimen blanks were sawed from each of the heat treated plates. The specimens were aged at either 325° or 350° F. for 6, 11, 20, 40, 80, 130 and 225 hours. After the peak strength aging practice was determined, additional plate from each of the alloys was aged to its particular peak strength condition.

The plates rolled from Group II, which received a higher first step homogenization temperature were given the same 1000° F. solution heat treatment practice as Group I. One plate from each of the five alloys was quenched into cold water, and the second plate of each alloy was quenched into 200° F. water. Each plate was stretched approximately 5% within two hours of quenching.

Aging curves at 350° and 375° F. were developed for the high Mg alloy (S-5). In addition, a two-step age of 36 hours at 375° F. plus 30 hours at 300° F. was evaluated and was used for aging the balance of the high Mg alloy plate.

Plates from the other four alloys in Group II were aged to the peak strength condition using the practices developed with the Group I material. Half of each peak aged plate was given an additional 100 hour exposure at 360° F. in order to evaluate elevated temperature stability.

The two Group III plates were solution heat treated at 1000° F. for one hour, cold water quenched and stretched 5%. Plate S-1 was aged 16 hours at 350° F., and plate S-4 was aged 80 hours at 350° F. One half of each plate was given an additional aging treatment of 100 hours at 360° F.

TABLE 4

GROUP I - PEAK AGE MECHANICAL PROPERTIES - 0.6" PLATE

| | | | Long Transverse | | | | Longitudinal | | | |
|---|---|---|---|---|---|---|---|---|---|---|
| S. No. | Quench | Age Hr. | UTS KSI | YS KSI | % El | CIE IN-LB/IN2 | UTS KSI | YS KSI | % El | CIE IN-LB/IN2 |
| S-1 (a) | COLD | 16 | 74.2 | 66.0 | 11.4 | 296 | 73.1 | 67.3 | 10.4 | 320 |
| S-1 (b) | HOT | 16 | 72.5 | 66.0 | 9.3 | 163 | 71.8 | 65.9 | 8.9 | 195 |
| S-3 (a) | COLD | 40 | 73.7 | 68.6 | 9.3 | 205 | 73.8 | 70.8 | 7.9 | 210 |
| S-3 (b) | HOT | 40 | 72.4 | 66.8 | 8.6 | 157 | 73.2 | 69.9 | 6.4 | 197 |
| S-4 (a) | COLD | 80 | 74.5 | 69.5 | 7.9 | 180 | 73.9 | 70.7 | 8.9 | 186 |
| S-4 (b) | HOT | 80 | 70.0 | 63.6 | 7.1 | 127 | 68.8 | 64.6 | 6.1 | 125 |
| S-2 (a) | COLD | 40 | 74.4 | 68.7 | 10.0 | 174 | 75.3 | 71.0 | 8.6 | 203 |

TABLE 4-continued

| GROUP I - PEAK AGE MECHANICAL PROPERTIES - 0.6" PLATE | | | | | | | | | | |
|---|---|---|---|---|---|---|---|---|---|---|
| | | | Long Transverse | | | | Longitudinal | | | |
| S. No. | Quench | Age Hr. | UTS KSI | YS KSI | % El | CIE IN-LB/IN2 | UTS KSI | YS KSI | % El | CIE IN-LB/IN2 |
| S-2 (b) | HOT | 40 | 71.1 | 64.8 | 7.5 | 127 | 71.9 | 67.4 | 7.1 | 144 |

Homo: 910F/1000F
Age: 350F
SHT: 1000F

Testing

Transverse tension tests were performed on 0.350"-diameter round specimens machined from Group I plate to develop aging curves for the selection of peak strength aging practices. Both hot and cold water quenched plate were aged to the peak strength condition and tested for longitudinal and long transverse tensile properties and for L-T and T-L sharp-notch Caarpy impact properties.

Plate from each alloy and quench combination in Group II was tested in the peak age and overage conditions. Duplicate tensile tests were performed on 0.350" round specimens from the longitudinal and long transverse directions and from samples taken at 45 degrees to the rolling direction. Fracture toughness testing was performed on W=2" compact tension specimens in the L-T and T-L directions. Short bar fracture toughness tests were performed on S-L specimens.

Corrosion testing was also conducted on Group II plate in each alloy, quench rate and age combination. Exfoliation corrosion resistance testing was performed on samples machined to expose the T/10 or T/2 plane using the standard practice, which combines ASTM G34-79 and ASTM G34-72. This practice consists of immersing the specimens, which have been degreased, weighed, and had their backs and sides taped, in the standard corrodent and rating their exfoliation resistance against photographic standards. After 48 hours of immersion, the specimens are removed from the corrodent and rated with the G34-79 photographic standards. The specimens are then cleaned in concentrated nitric acid for 30 minutes and rated with the photographic standards in G34-72. Loose exfoliated metal is removed from the samples by brushing them with a nylon bristle brush and rinsing. They are then allowed to dry and are reweighed.

Stress corrosion cracking (SCC) resistance testing was performed on C-ring specimens which were machined and prepared in accordance with ASTM G38. The C-rings were oriented such that the bolt-applied-load tensile stressed the outer fibers in the short transverse direction. The testing was conducted according to ASTM Standard G47 with the alternate immersion exposure conducted for 20 days per ASTM Standard G44. The C-ring specimens were stressed to 25, 30 or 35 ksi, waxed, and degreased prior to exposure. Examinations for failures were made each working day throughout the exposure with a microscope at a magnification of at least 10×. After completion of the exposure the specimens were cleaned in concentrated nitric acid to remove corrosion products which might have masked SCC and were reexamined.

Evaluations performed on peak aged and overaged (peak age plus 100 hours at 360° F.) Group III plate included tensile testing of 0.350" round specimens from the longitudinal and long transverse directions and 0.114" round specimens in the short transverse direction. Fracture toughness testing was conducted on W=2" compact tension specimens in the L-T and T-L orientations and on W=1" specimens from the S-L orientation. Exfoliation corrosion tests were performed at the T/10 and T/2 planes, and SCC tests were conducted on ASTM G47 C-rings as described above.

The Group III plates were also evaluated for SCC performance using $K_{ISCC}$ specimens. Duplicate S-L, double cantilever beam (DCB) specimens were machined from peak and overaged plate. The DCB specimens were mechanically precracked by tightening the two opposing bolts. The precracks propagated approximately 0.1" beyond the end of the chevron. The deflection of the two cantilever arms at the bolt centerline was measured optically with a tool maker's microscope. The bolt ends of the specimens were masked to prevent any galvanic action.

The tests were conducted in an alternate immersion chamber where the air temperature (80° F.) and relative humidity (45%) are controlled. To begin the tests, the specimens were positioned bolt end up and several droplets of 3.5% NaCl solution were placed in the precracks. Additional applications of the NaCl solution were made three times each working day at approximately four hour intervals. Crack lengths were measured periodically using a low power, traveling microscope. The crack length values reported are the average of the measurements obtained from two sides of the specimens.

Data for the DCB tests are expressed in the form of crack length versus time and crack growth rate versus stress intensity plots. Linear regression analyses were used to fit the crack length/time data for each specimen with an equation of the form $a = m\ln(1/t) + b$; where a is cracklength, t is time, m is slope and b is the intercept. The slope (da/dt) of the resulting curve was used to generate crack growth rate data. Stress intensities ($K_I$) were calculated from the relation given by Mostovoy et al: "Use of Crack Line Loaded Specimens for Measuring Plane Strain Fracture Toughness," *Journal of Basic Engineering, Transactions ASME*, p. 661, 1967.

$$K_I = \frac{vEh[3h(a + 0.6h) + h^3]^{\frac{1}{2}}}{4[(a + 0.6h)^3 + h^2a]}$$

where v is the total deflection of the two DCB arms at the load line, E is the modulus of elasticity (used as $11.0 \times 10^3$ ksi), h is the specimen half height and a is the crack length measured from the load line.

In addition, ST tensile tests, S-L fracture toughness tests and S-L SCC C-ring tests were performed on samples which had been peak aged and then given an additional 1000 hour exposure at 200° F.

RESULTS AND DISCUSSION

Aging Practices

The aging curves developed for the four alloys in Group I and the high Mg alloy (S-5) from Group II are shown graphically in FIGS. 1-5. An examination of the data used to develop the curves shows that increasing the Mg level slows down the aging kinetics for the alloys and that using a hot water quench lowers the yield strength in the peak age condition. At 325° F., the Mg free alloy (S-1) reached peak strength after 40 hours while the 1.5% Mg alloy (S-4) had not reached peak strength after 225 hours of aging. At 350° F. the Mg free alloy reached peak strength after ~16 hours, the 0.67% Mg and 1.0% Mg alloys after ~40 hours and the 1.5% Mg alloy after ~80 hours. The 2.3% Mg alloy (S-5) did not reach peak strength after as much as 160 hours of aging at 350° F. Therefore, additional specimens were aged at 375° F. to develop a peak strength condition.

Figure 5:
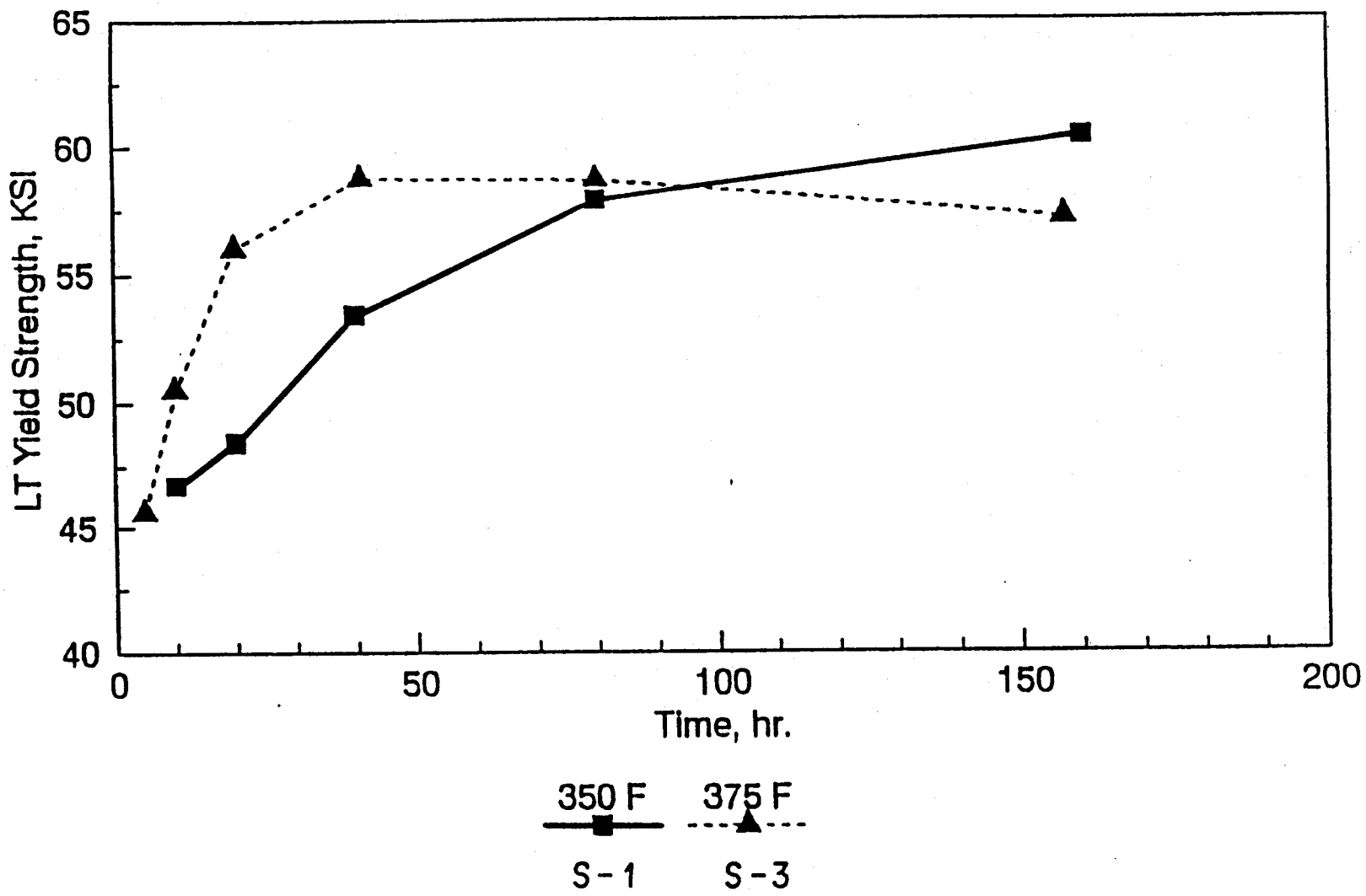

As can be seen in FIG. 5, peak strength was reached after approximately 40 hours at 375° F., but the maximum yield strength obtained was only 58.7 ksi. A two step age of 36 hours at 375° F. plus 30 hours at 300° F. was evaluated in an attempt to increase the maximum strength closer to the goal of 65 ksi. The two step practice did increase the long transverse yield strength to 61.1 ksi for the cold water quenched plate, but the LT yield strength was only 57.1 ksi for the plate which had been quenched in 200° F. water (Table 5).

Additional Group I plate was aged using the 350° F. peak strength practices and tested in order to confirm the peak properties obtained in the development of the aging curves and to screen the alloys for toughness using sharp-notch Charpy specimens. The data obtained is given in Table 4 and shows good reproducibility with the earlier tests. An examination of the data shows the longitudinal properties to be slightly higher than those in the long transverse direction. A more significant difference can be seen between the results from the cold water quenched plate and the plate quenched in 200° F. water. Both strength and Charpy impact energy were lower when the slower, hot water quench was used.

Group II Alloy Characterization

Figure 6:
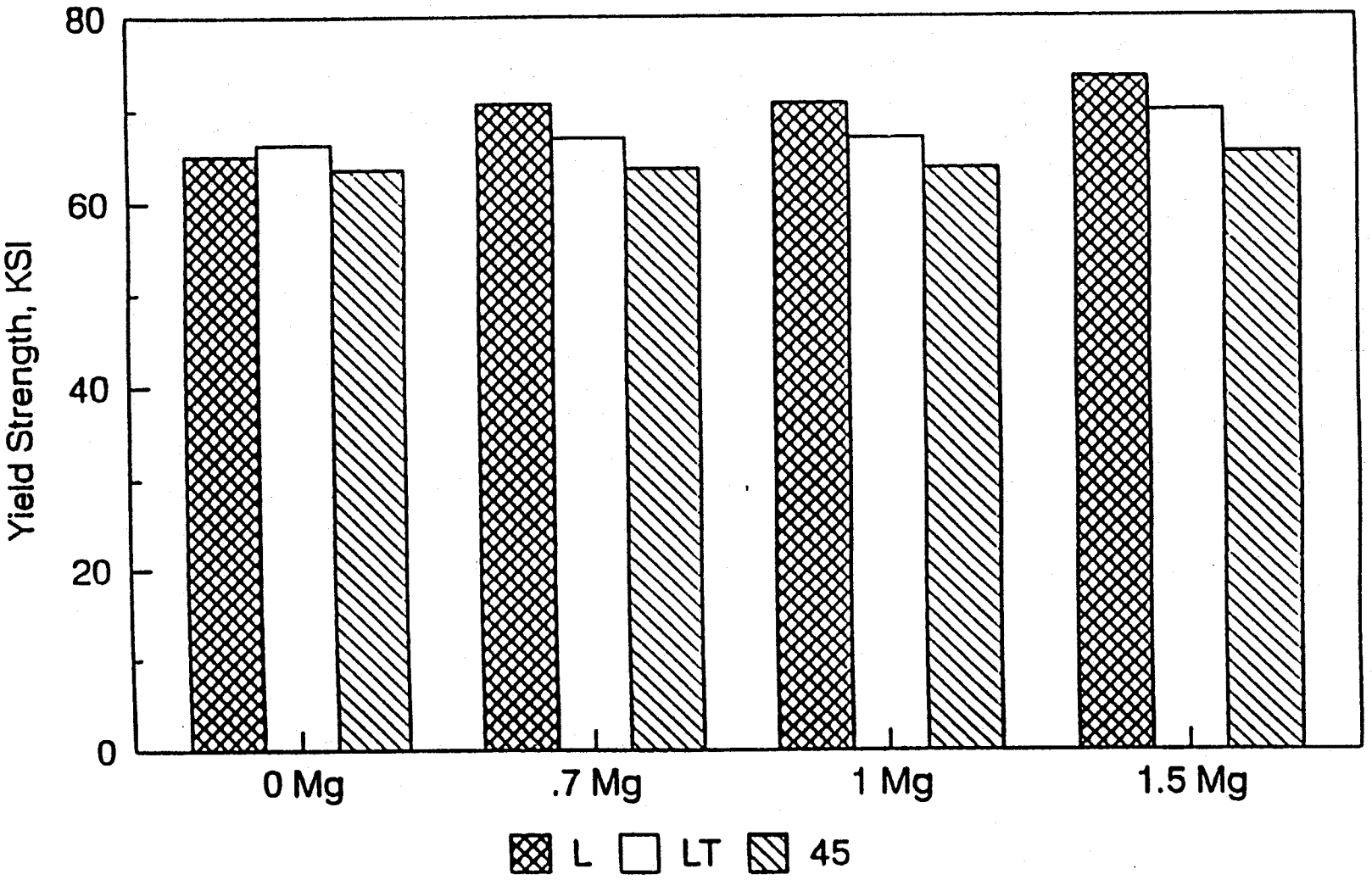
FIG. 6 is a graph illustrating strength and anisotropy of alloys produced according to the invention.

Mechanical Properties—Because of the difficulties in processing the high Mg alloy and the fact that it did not attain the desired level of mechanical properties, it was considered unsatisfactory and not comparable to the other four alloys processed in Group II. Mechanical properties of the four alloys are given in Table 6. An examination of the tensile data shows a small variation between the L, LT and 45 degree directions. As can be seen in FIG. 6, the variation is the lowest in the Mg free alloy but is relatively low in all cases as compared to that seen in most other Al-Li alloys.

TABLE 5

MECHANICAL PROPERTIES OF HIGH MG ALLOY #S-5 TWO STEP AGE

| S. NO. | HOM 1ST STEP | HOMO 2ND STEP | QUENCH | AGE HR/ DEG F. | POST AGE THER-MAL HR/ DEG F. | LONG TRANSVERSE UTS KSI | LONG TRANSVERSE YS KSI | LONG TRANSVERSE % El | LONGI-TUDINAL UTS KSI | LONGI-TUDINAL YS KSI | LONGI-TUDINAL % El | 45 DEGREE UTS KSI | 45 DEGREE YS KSI | 45 DEGREE % El | Klc (Kq) KSI SQ RT IN T-L | Klc (Kq) KSI SQ RT IN L-T | Klc (Kq) KSI SQ RT IN S-L |
|---|---|---|---|---|---|---|---|---|---|---|---|---|---|---|---|---|---|
| S-5 | 970 | 1000 | COLD | 36/375 + 30/300 | NONE | 68 | 61.1 | 9.5 | | | | | | | | | |
| S-5 | 970 | 1000 | HOT | 36/375 + 30/300 | NONE | 65.4 | 57.1 | 8.2 | | | | | | | | | |
| S-5 | 970 | 1000 | COLD | 36/375 + 30/300 | NONE | 67.4 | 61.2 | 10.4 | 69.6 | 65.1 | 7.9 | 64.6 | 59.3 | 6.1 | 32.8 | 33.8 | 11.3 |
| S-5 | 970 | 1000 | COLD | 36/375 + 30/300 | 100/360 | 65.3 | 59.4 | 10 | 68.3 | 63 | 8.6 | | | | 30.1 | 30.8 | 15 |
| S-5 | 970 | 1000 | HOT | 36/375 + 30/300 | NONE | 65.4 | 58.4 | 7.9 | 66 | 60.9 | 7.1 | 62.1 | 55.4 | 9.6 | 26.3 | 24.6 | 14.8 |
| S-5 | 970 | 1000 | HOT | 36/375 + 30/300 | 100/360 | 63 | 55.1 | 6.8 | 64.1 | 57.5 | 7.1 | | | | 25.7 | 25.6 | 13.6 |

TABLE 6

MECHANICAL PROPERTIES OF GROUP II 0.6" PLATE

| S. NO. | % Mg | HOMO 1ST STEP | HOMO 2ND STEP | QUENCH | AGE HR/DEG F. | LONG TRANSVERSE UTS (KSI) | LONG TRANSVERSE YS (KSI) | LONG TRANSVERSE % El | LONGITUDINAL UTS (KSI) | LONGITUDINAL YS (KSI) | LONGITUDINAL % El |
|---|---|---|---|---|---|---|---|---|---|---|---|
| S-1 | 0.0 | 970 | 1000 | COLD | 16/350 | 72.7 | 66.3 | 10.7 | 70.8 | 65.1 | 11.8 |
| S-1 | 0.0 | 970 | 1000 | COLD | 16/350 + 100/360 | 66.0 | 57.4 | 11.8 | 65.0 | 56.3 | 12.5 |
| S-3 | 1.0 | 950 | 1000 | COLD | 40/350 | 72.2 | 67.0 | 8.9 | 73.9 | 70.8 | 8.2 |
| S-3 | 1.0 | 950 | 1000 | COLD | 16/350 + 100/360 | 71.5 | 66.6 | 10.4 | 72.7 | 68.8 | 8.2 |
| S-4 | 1.5 | 950 | 1000 | COLD | 80/350 | 74.5 | 69.9 | 8.6 | 76.2 | 73.5 | 8.6 |
| S-4 | 1.5 | 950 | 1000 | COLD | 16/350 + 100/360 | 72.9 | 68.3 | 8.6 | 74.1 | 70.1 | 8.6 |
| S-2 | 0.7 | 950 | 1000 | COLD | 40/350 | 72.6 | 67.0 | 9.6 | 74.6 | 70.6 | 8.6 |
| S-2 | 0.7 | 950 | 1000 | COLD | 16/350 + 100/360 | 70.3 | 64.2 | 10.7 | 71.7 | 66.5 | 9.3 |
| S-1 | 0.0 | 970 | 1000 | HOT | 16/350 | 71.4 | 65.8 | 12.1 | 71.6 | 65.8 | 12.5 |
| S-1 | 0.0 | 970 | 1000 | HOT | 16/350 + 100/360 | 65.5 | 56.4 | 10.7 | 65.9 | 57.9 | 12.1 |
| S-3 | 1.0 | 950 | 1000 | HOT | 40/350 | 71.9 | 66.5 | 8.2 | 72.4 | 68.9 | 7.1 |
| S-3 | 1.0 | 950 | 1000 | HOT | 16/350 + 100/360 | 68.6 | 62.6 | 7.9 | 70.3 | 65.0 | 7.1 |
| S-4 | 1.5 | 950 | 1000 | HOT | 80/350 | 70.9 | 65.7 | 7.1 | 71.2 | 67.5 | 7.1 |
| S-4 | 1.5 | 950 | 1000 | HOT | 16/350 + 100/360 | 68.9 | 63.1 | 8.6 | 68.4 | 62.7 | 7.1 |
| S-2 | 0.7 | 950 | 1000 | HOT | 40/350 | 72.4 | 66.4 | 9.3 | 74.0 | 69.7 | 7.9 |
| S-2 | 0.7 | 950 | 1000 | HOT | 16/350 + 100/360 | 69.2 | 62.9 | 7.9 | 70.3 | 64.8 | 7.1 |

| S. NO. | 45 DEGREE UTS (KSI) | 45 DEGREE YS (KSI) | 45 DEGREE % El | Klc (Kq) KSI SQ RT IN T-L | Klc (Kq) KSI SQ RT IN L-T | Klc (Kq) KSI SQ RT IN KIV S-L |
|---|---|---|---|---|---|---|

TABLE 6-continued

MECHANICAL PROPERTIES OF GROUP II 0.6" PLATE

| | | | | | | |
|---|---|---|---|---|---|---|
| S-1 | 70.1 | 63.6 | 12.5 | (38.5) | (42.3) | 28.1 |
| S-1 | 64.0 | 65.4 | 13.9 | (38.8) | (38.7) | 23.0 |
| S-3 | 69.3 | 63.6 | 12.9 | 31.4 | 32.9 | 19.3 |
| S-3 | 68.7 | 63.6 | 12.1 | (32.9) | (37.5) | 16.0 |
| S-4 | 71.3 | 65.4 | 9.3 | 27.3 | 30.5 | 20.8 |
| S-4 | 70.2 | 65.3 | 10.7 | 26.0 | 30.0 | 18.6 |
| S-2 | 69.9 | 63.8 | 12.9 | 29.9 | 30.2 | 17.8 |
| S-2 | 67.4 | 61.5 | 10.0 | 28.0 | (27.9) | 17.3 |
| S-1 | 69.5 | 63.4 | 11.4 | 28.0 | 30.4 | 12.2 |
| S-1 | 64.4 | 56.4 | 12.9 | 24.9 | (30.3) | 16.4 |
| S-3 | 68.6 | 62.6 | 10.0 | 26.2 | 27.8 | 12.5 |
| S-3 | 67.0 | 60.9 | 7.9 | 21.3 | 22.2 | 16.7 |
| S-4 | 67.2 | 61.3 | 8.9 | 22.3 | 27.5 | 13.1 |
| S-4 | 66.2 | 60.6 | 8.9 | 21.1 | (22.2) | 12.4 |
| S-2 | 69.3 | 63.3 | 10.0 | 22.9 | 23.8 | 11.4 |
| S-2 | 66.5 | 60.4 | 9.3 | 20.8 | (23.0) | 12.2 |

Figure 7:
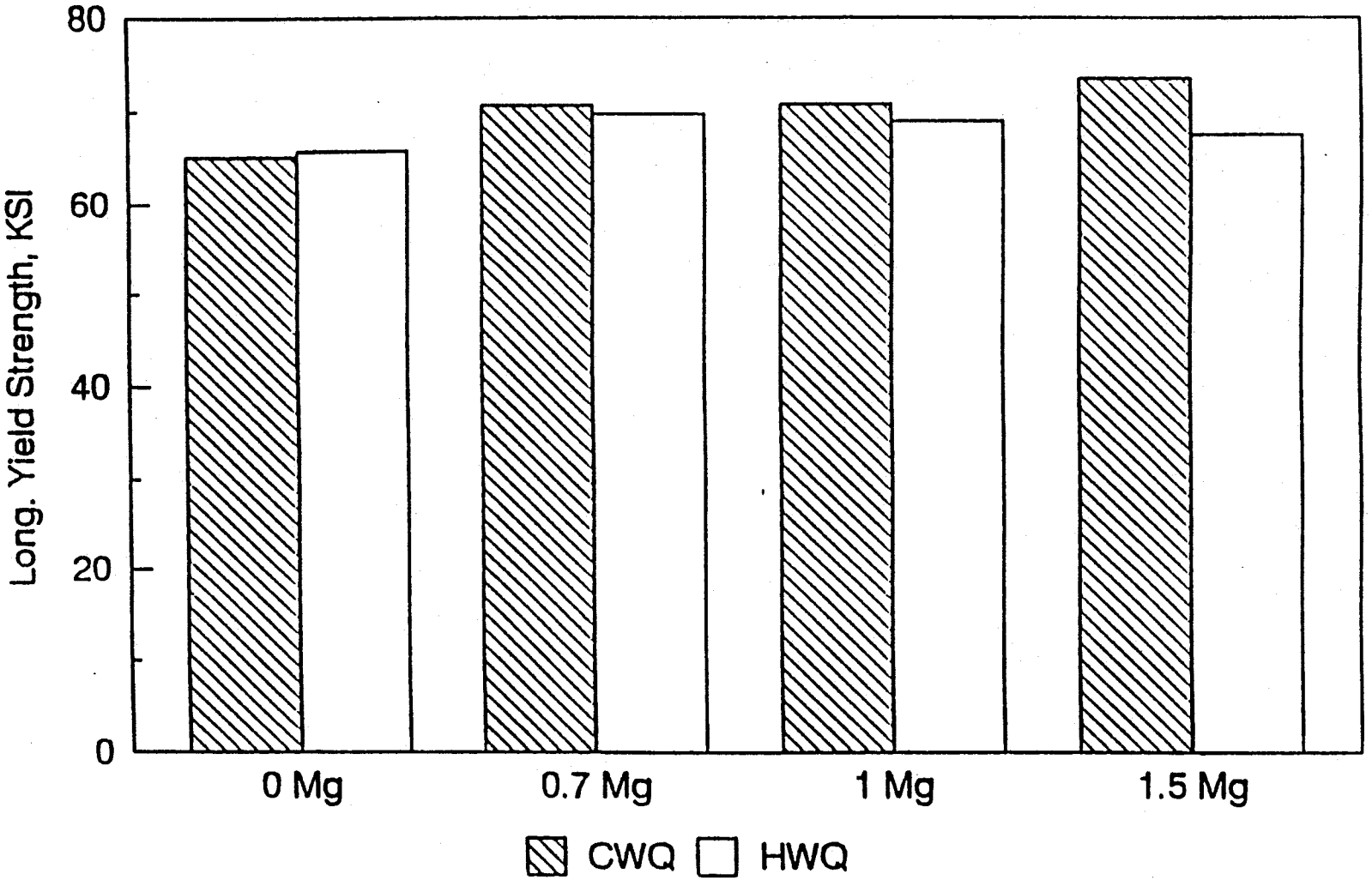
FIGS. 7, 8, 9 and 10 are graphs showing quench sensitivity of alloys produced according to the invention.
Figure 8:
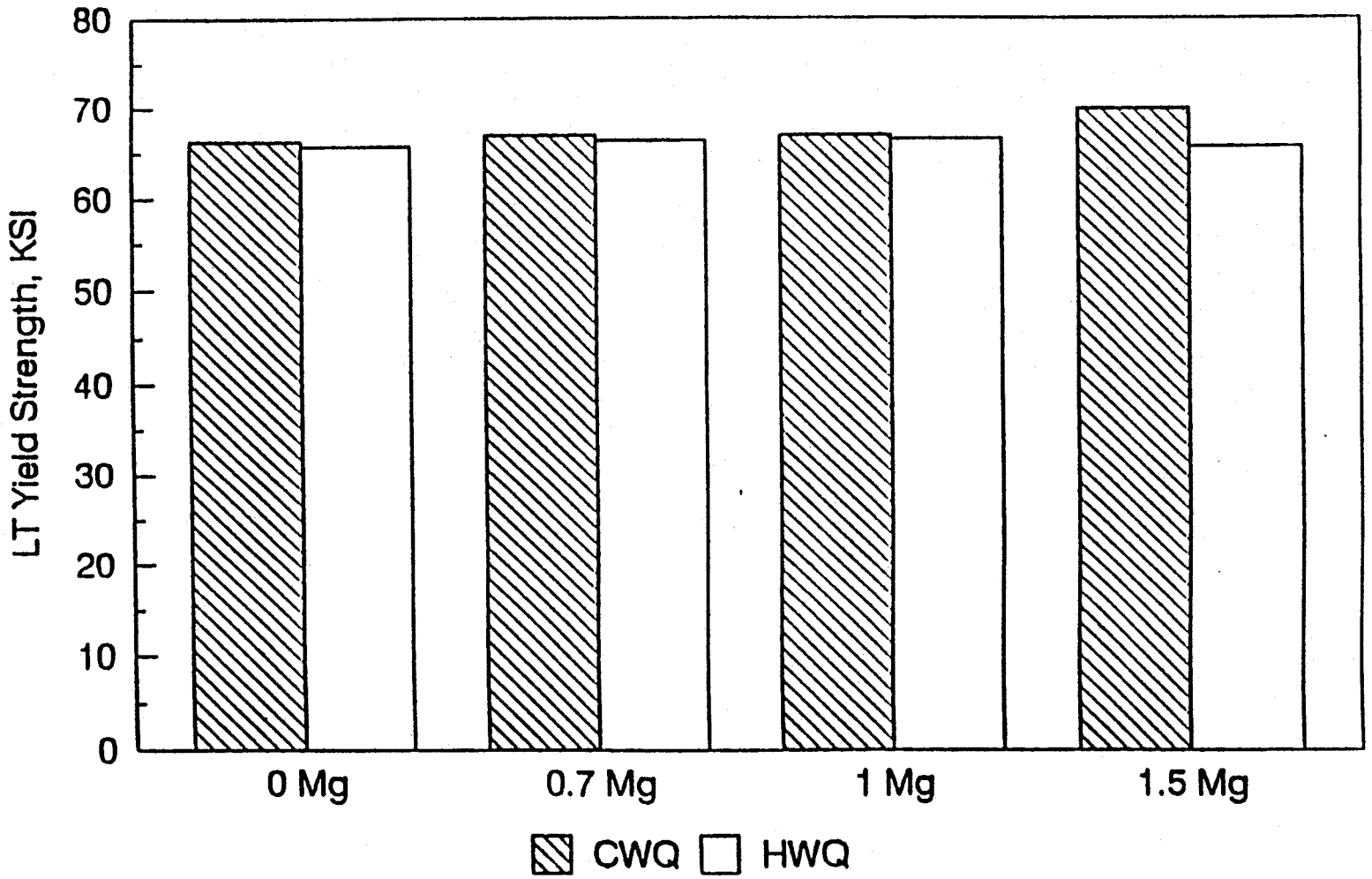
Figure 9:
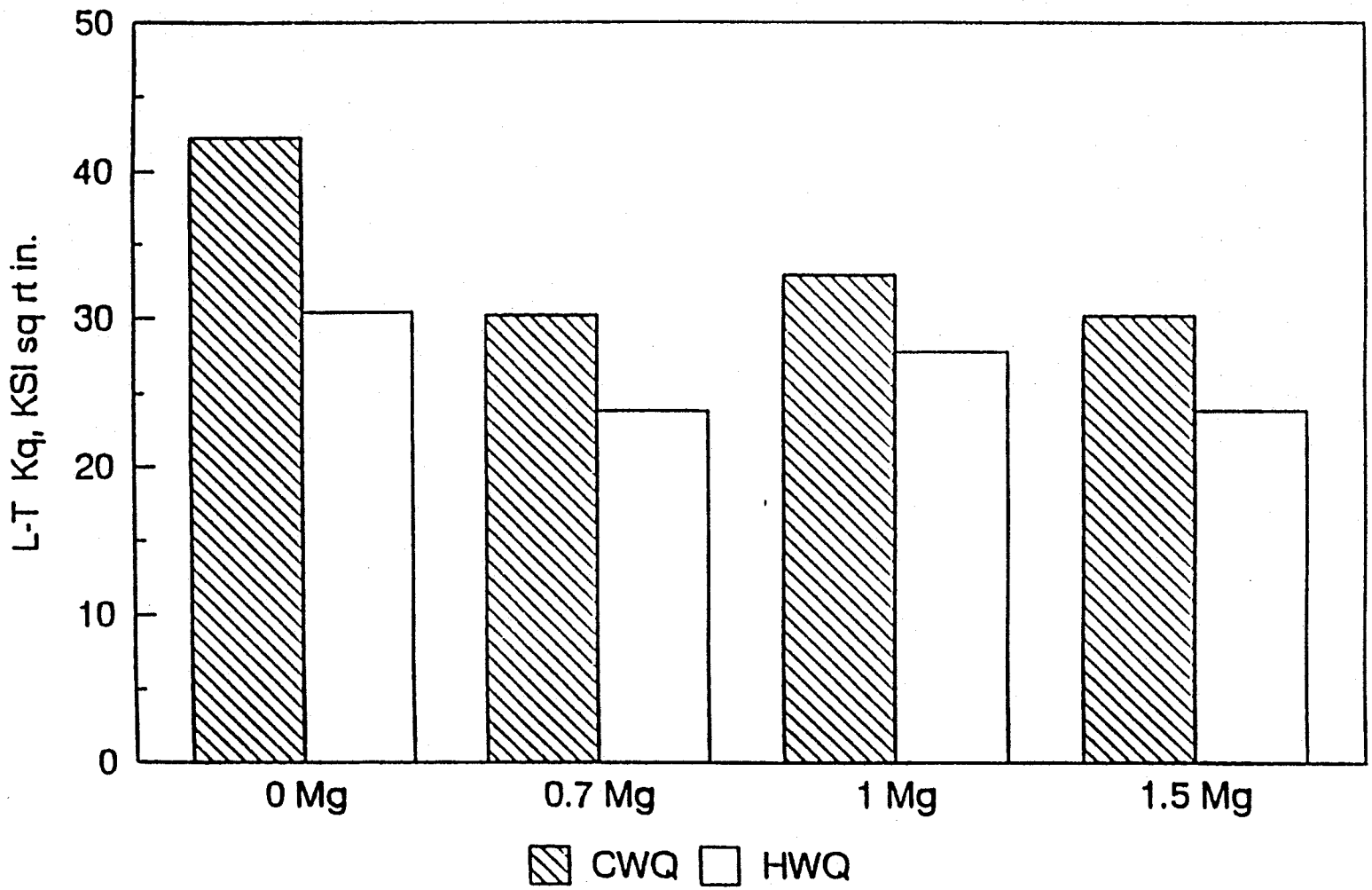
Figure 10:
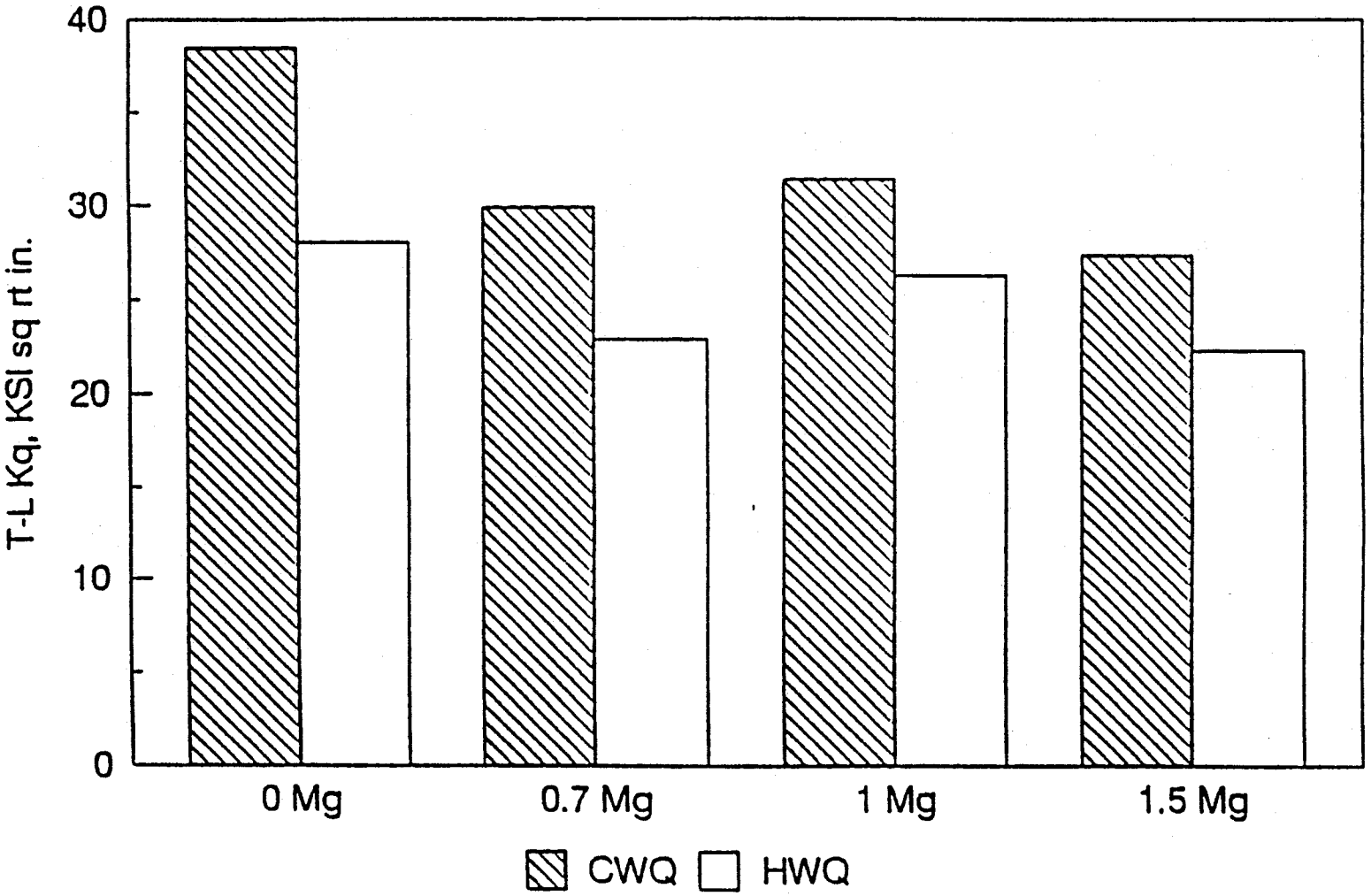
Figure 11:
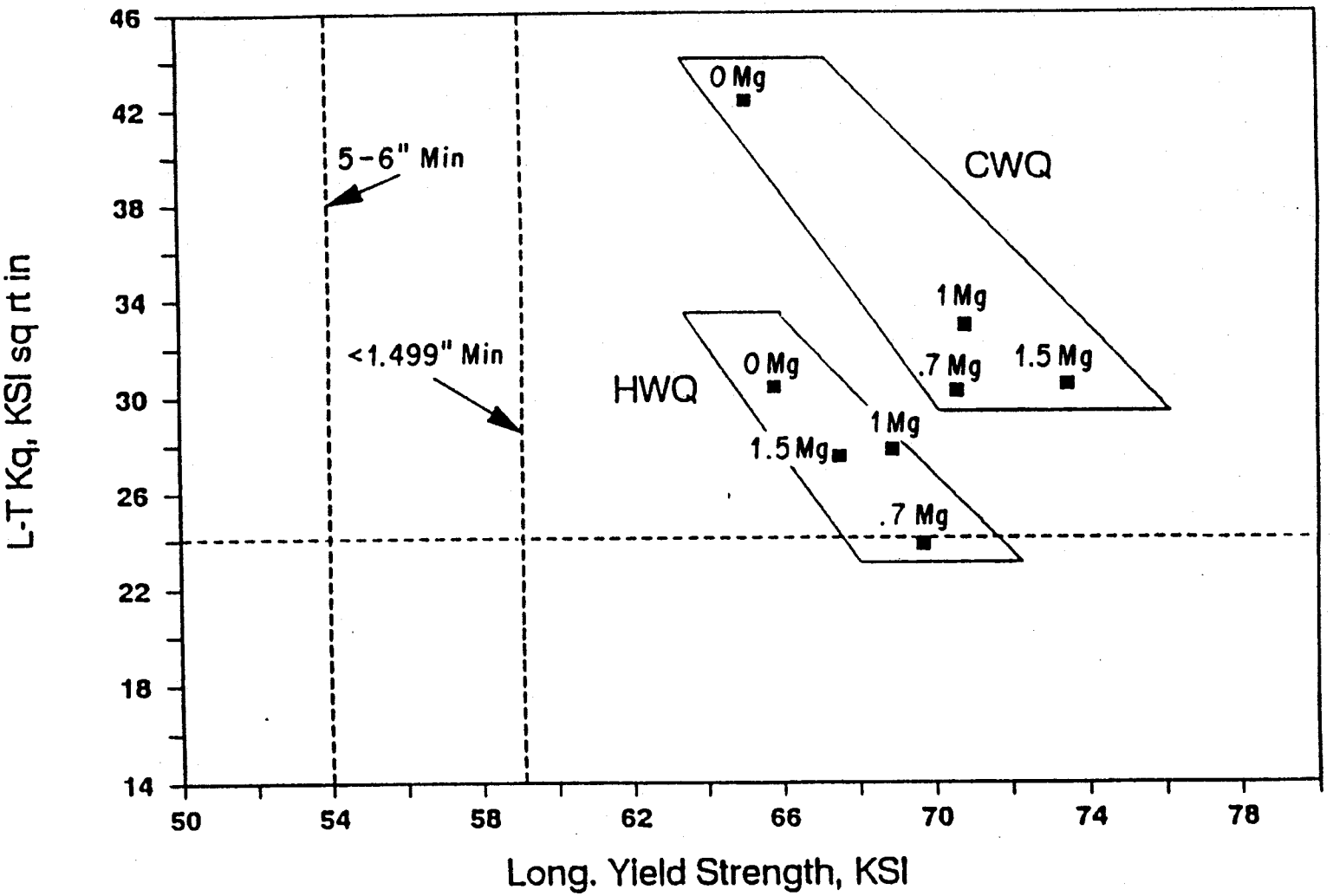
FIG. 11 is a graph showing strength-toughness combinations of alloys of the invention as a function of quench rate.
Figure 12:
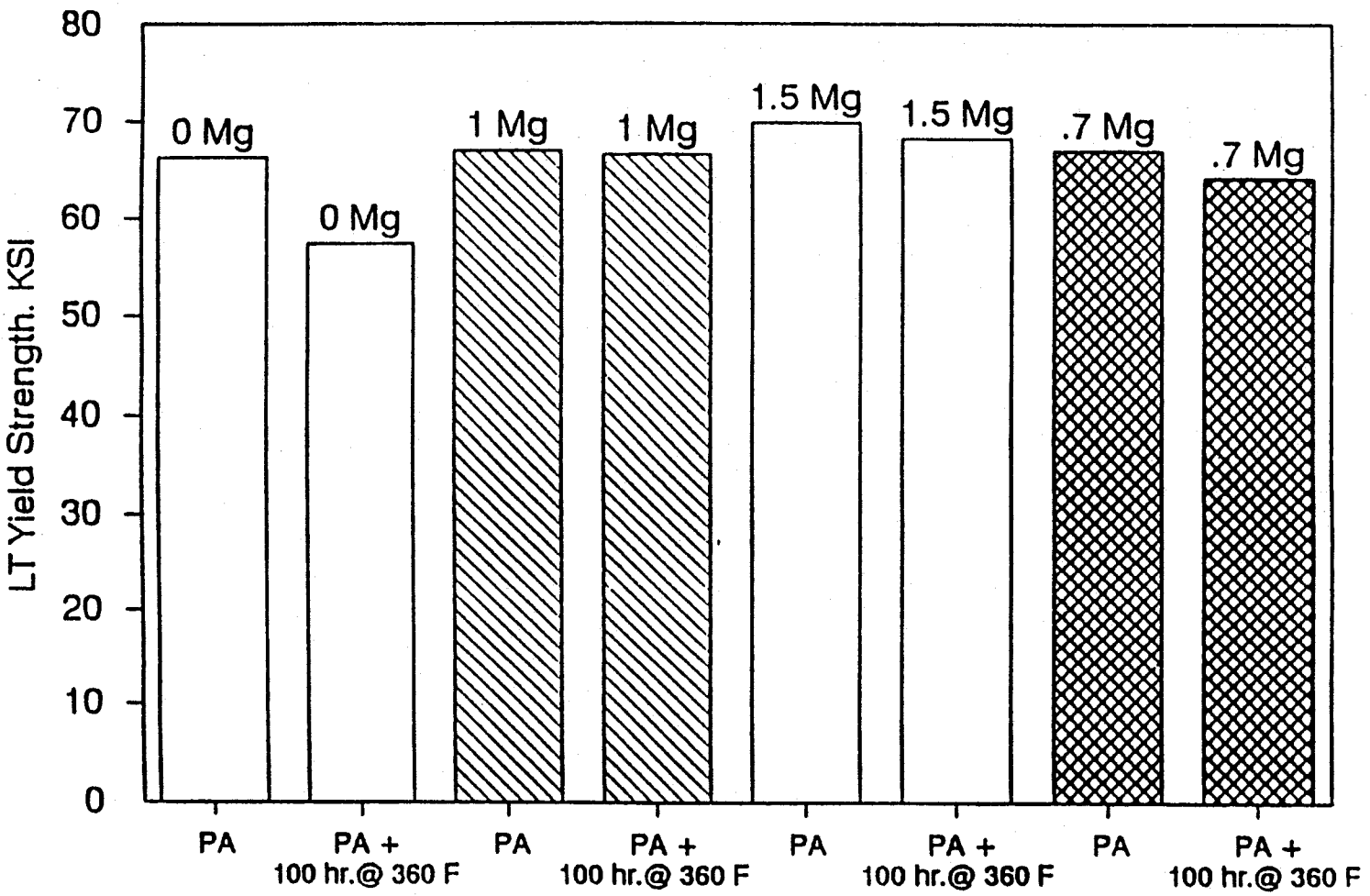
FIGS. 12, 13, 14 and 15 are bar graphs showing the effect of thermal exposure on alloys under different quenching conditions.
Figure 13:
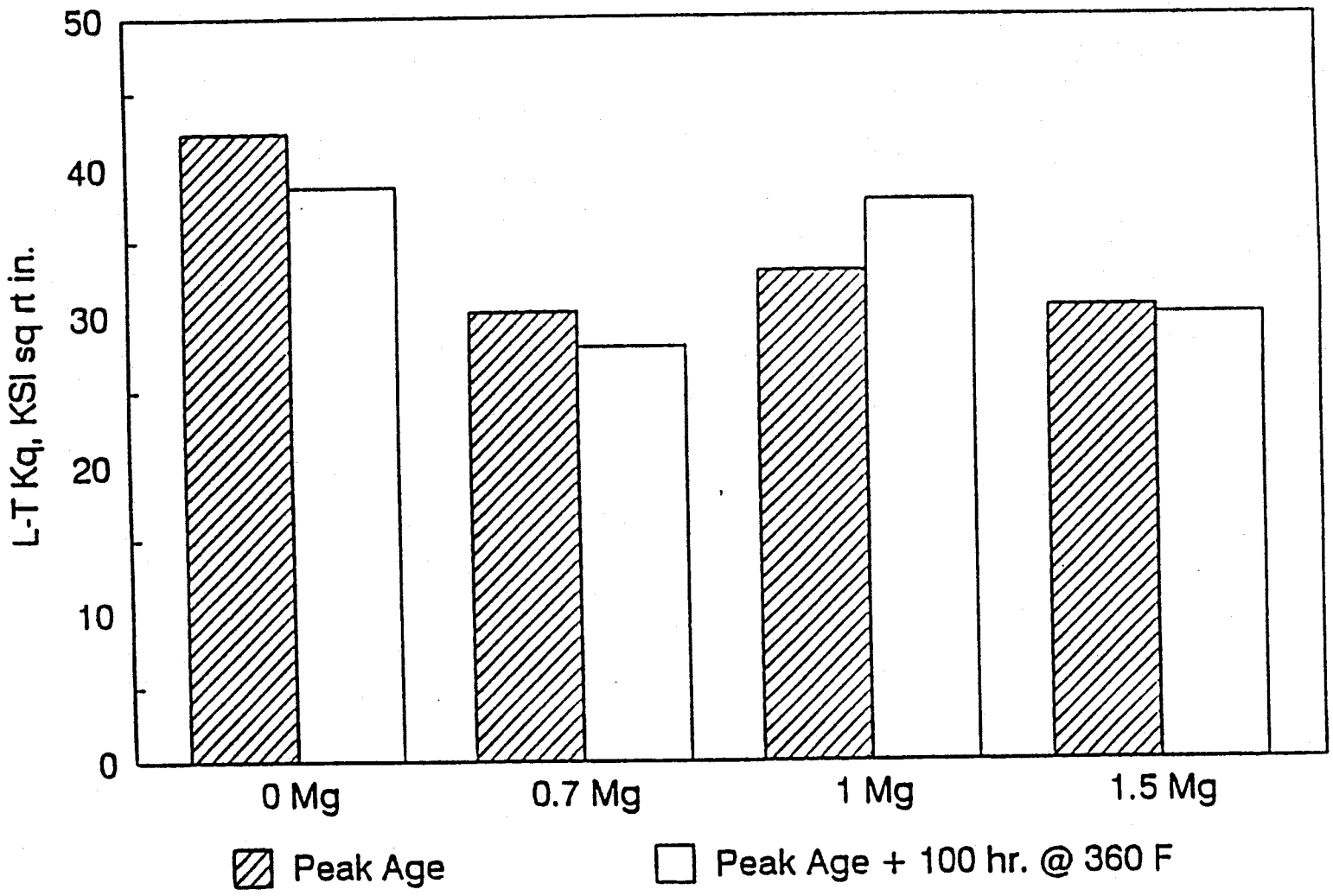
Figure 14:
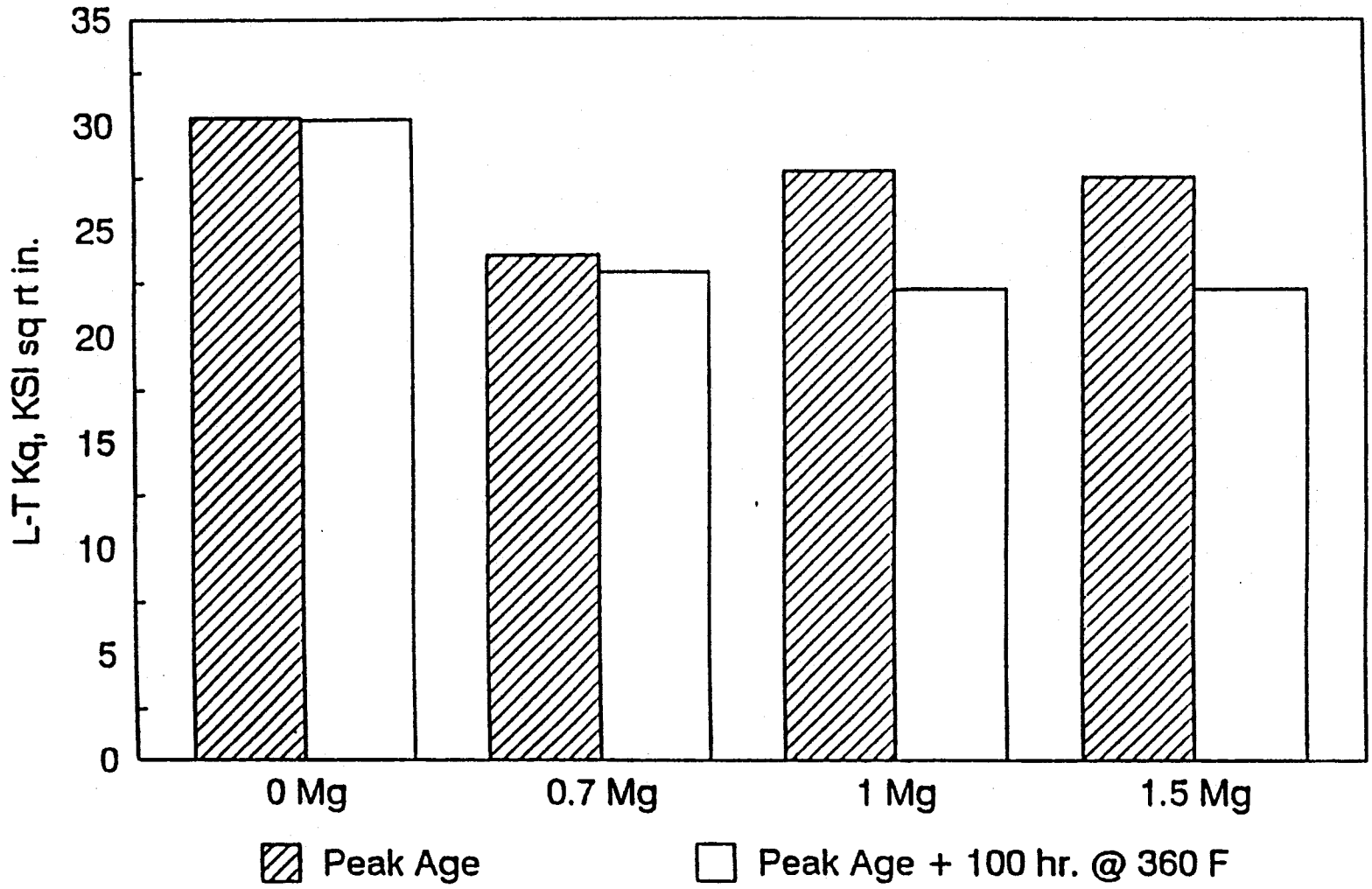
Figure 15:
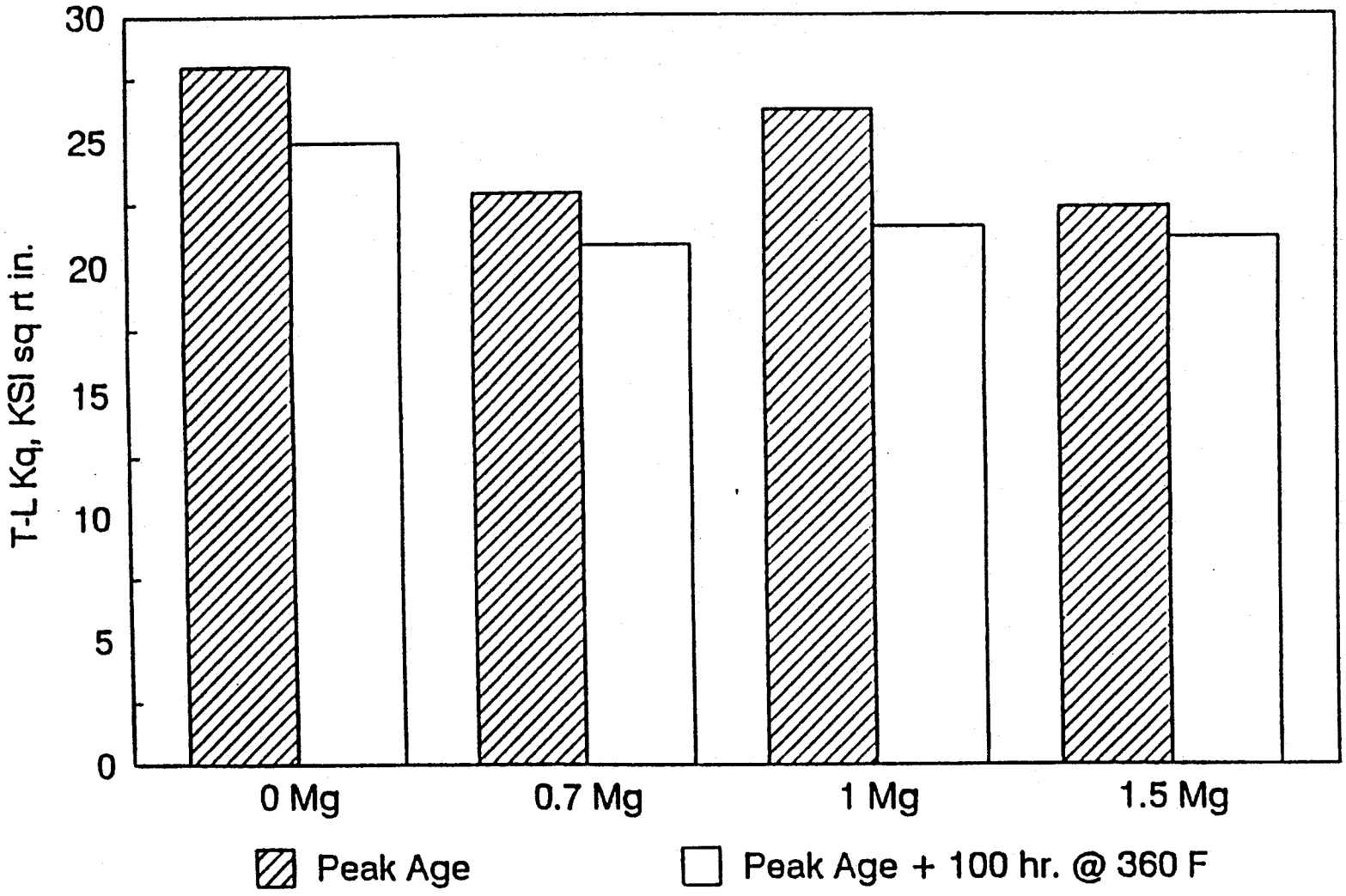

FIGS. 7 and 8 indicate that all four alloys have minimal yield strength quench sensitivity. However, the use of a hot water quench had a much more significant effect on toughness as can be seen in FIGS. 9 and 10. The effect of quench on the yield strength and toughness combination is shown in FIG. 11. Here it would appear that the Mg-free alloy had by far the greatest quench sensitivity, but it should be kept in mind that many of the Kq toughnesses were not valid $K_{1c}$ values. This could distort the apparent quench rate effects.

The thermal stability of the four alloys, as indicated by a 100 hour exposure at 360° F., is shown in FIGS. 12–15. Only the Mg free alloy exhibits much effect on yield strength due to the overaging. However, all four alloys show some degradation in toughness; particularly when the plate had received a hot water quench. The fact of magnesium improving the thermal stability was not unexpected based on the slower aging kinetics with increasing Mg content which had been exhibited in the development of aging curves for the alloys. This effect had been expected based on the results of other Al-Cu-Mg-Li alloys, and the Mn was added in the Mg free alloy in an attempt to achieve some of the thermal stability imparted by the magnesium.

Mechanical properties of the high Mg alloy (S-5) are given in Table 5. The variations in properties due to test direction, quench rate and overaging follow the same trends as were exhibited by the other Mg containing alloys in Group II.

Corrosion Results—All five of the alloys exhibited excellent exfoliation corrosion resistance based on their performance in the EXCO test. They were rated EA or better regardless of composition, quench rate, aging condition (peak or overaged) or plane tested. Much more variation was observed in the SCC response of the alloys as can be seen in Tables 7 and 8. The Mg-free alloy passed at all stresses up to 35 ksi for all of the conditions evaluated, but all of the Mg containing alloys experienced some failures. It appears that the two alloys with the highest Mg level were somewhat more resistant to SCC, but there is a great deal of scatter in the results. This scatter was possibly exacerbated by the fact that subsize C-rings had to be used because of the gauge plate (0.6") being tested. No SCC indications were revealed by metallography of the Mg-free alloy.

TABLE 7

Group II - Stress Corrosion Test Results of 0.6" Plate (C-rings, 3.5% NaCl Alternate Immersion)

| S No. | Quench | Age (Hrs. @ °F.) | Stress | Days No Failure | Days to Failure |
|---|---|---|---|---|---|
| S-1 | Cold Water | 16 @ 350 | 35 | 20, 20, 20 | |
| | | | 25 | 21, 21, 21 | |
| | | | 30 | 21, 21, 21 | |
| | | 16 @ 350 + 100 @ 360 | 25 | 21, 21, 21 | |
| | | | 30 | 21, 21, 21 | |
| | | | 35 | 20, 20, 20 | |
| S-1 | Hot Water | 16 @ 350 | 25 | 21, 21, 21 | |
| | | | 30 | 21, 21, 21 | |
| | | 16 @ 350 + 100 @ 360 | 25 | 21, 21, 21 | |
| | | | 30 | 21, 21, 21 | |
| | | | 35 | 20, 20, 20 | |
| S-3 | Cold Water | 40 @ 350 | 30 | 21 | 3, 4 |
| | | | 35 | | 5, 5, 5 |
| | | 40 @ 350 + 100 @ 360 | 30 | 21, 21 | 7 |
| | | | 35 | 20 | 5, 5 |
| S-3 | Hot Water | 40 @ 350 | 25 | 21 | 4, 4 |
| | | | 30 | | 3, 7, 15 |
| | | | 35 | | 5, 5, 7 |
| | | 40 @ 350 + 100 @ 360 | 25 | 21, 21 | 7 |
| | | | 30 | 21, 21, | 4 |
| | | | 35 | | 5, 5, 5 |
| S-4 | Cold Water | 80 @ 350 | 25 | 21, 21, 21 | |
| | | | 30 | 21 | 4, 7 |
| | | | 35 | 21 | 3, 7 |
| | | 80 @ 350 + 100 @ 360 | 25 | 21, 21, 21 | |
| | | | 30 | 21, 21 | 7 |
| | | | 35 | 21, 21 | 10 |

TABLE 7-continued

| Group II - Stress Corrosion Test Results of 0.6" Plate (C-rings, 3.5% NaCl Alternate Immersion) | | | | | |
|---|---|---|---|---|---|
| S No. | Quench | Age (Hrs. @ °F.) | Stress | Days No Failure | Days to Failure |
| S-4 | Hot Water | 80 @ 350 | 25 | 21, 21, 21 | |
| | | | 30 | 21, 21 | 12 |
| | | | 35 | 21, 21, 21 | |
| | | 80 @ 350 + 100 @ 360 | 25 | 21, 21, 21 | |
| | | | 30 | 21, 21, 21 | |
| | | | 35 | 21, 21 | 8 |
| S-2 | Cold Water | 40 @ 350 | 25 | 21 | 7, 7 |
| | | | 30 | 21, 21 | 3 |
| | | | 35 | 20, 20 | 5 |
| | | 40 @ 350 + 100 @ 360 | 25 | 21 | 4, 7 |
| | | | 30 | 21, 21 | 7 |
| | | | 35 | | 5, 5, 6 |
| S-2 | Hot Water | 40 @ 350 | 25 | 21, 21, 21 | |
| | | | 30 | 21, 21 | 21* |
| | | | 35 | 20 | 5, 5 |
| | | 40 @ 350 + 100 @ 360 | 25 | 21, 21 | 7 |
| | | | 30 | 21 | 7, 7 |
| | | | 35 | | 6, 20, 20 |

*Crack found after cleaning in nitric acid

TABLE 8

| Results of Stress Corrosion Tests High Mg Alloy #S-5 | | | | | | |
|---|---|---|---|---|---|---|
| S. No. | Quench | Age Hrs./F. | Post Age Thermal Hrs./F. | Stress, KSI | Days No Failure | Days To Fail |
| S-5(a) | Cold Water | 36/375 + 30/300 | None | 25 | 20, 20, 20 | |
| S-5(a) | Cold Water | 36/375 + 30/300 | None | 30 | 20, 20, 20 | |
| S-5(a) | Cold Water | 36/375 + 30/300 | None | 35 | 20 | 2, 2 |
| S-5(b) | Cold Water | 36/375 + 30/300 | 100/360 | 25 | 20, 20, 20 | |
| S-5(b) | Cold Water | 36/375 + 30/300 | 100/360 | 30 | 20, 20, 20 | |
| S-5(b) | Cold Water | 36/375 + 30/300 | 100/360 | 35 | 20, 20, 20 | |
| S-5(c) | Hot Water | 36/375 + 30/300 | None | 25 | 20, 20 | 20* |
| S-5(c) | Hot Water | 36/375 + 30/300 | None | 35 | 20, 20, 20 | |
| S-5(d) | Hot Water | 36/375 + 30/300 | 100/360 | 25 | 20, 20, 20 | |
| S-5(d) | Hot Water | 36/375 + 30/300 | 100/360 | 30 | 20, 20, 20 | |
| S-5(d) | Hot Water | 36/375 + 30/300 | 100/360 | 35 | 20, 20, 20 | |

*crack observed after cleaning in nitric acid
0.6" plate - subsize c-rings

Group III (1.25") Plate Evaluation

Mechanical property and corrosion test results from the two alloys processed to 1.25" gauge are given in Table 9. Both alloys achieved the desired property goals including those in the short transverse direction. C-ring testing at a 25 ksi stress level in both peak and overaged conditions. Because of limited metal availability only plate S-4 in the peak age condition was stress corrosion tested at a 35 ksi stress level, and it did pass the 20 day exposure.

TABLE 9

| Properties of Group III 1.25" Plate | | | | | |
|---|---|---|---|---|---|
| | S-1 PEAK AGE | S-1 OVER AGE | S-4 PEAK AGE | S-4 OVER AGE | PEAK PROPERTY GOALS (5-6") |
| AGE TEMP | 350 | 360 | 350 | 360 | |
| AGE TIME | 16 | 100 | 80 | 100 | |
| UTS L | 73.6 | 66.4 | 74.0 | 71.1 | 63 |
| YS L | 68.0 | 58.2 | 71.0 | 66.8 | 54 |
| % EL L | 11.4 | 12.1 | 9.6 | 10.0 | 5 |
| K1C L-T | 34.4 | 33.8 | 29.3 | 29.7 | 24 |
| UTS LT | 72.4 | 65.2 | 71.0 | 70.6 | 63 |
| YS LT | 66.6 | 57.8 | 66.6 | 65.8 | 54 |
| % EL LT | 10.0 | 9.6 | 8.6 | 8.6 | 4 |
| K1C T-L | 31.1 | 30.5 | 24.8 | 24.8 | 20 |
| UTS ST | 67.9 | 63.1 | 68.0 | 67.1 | 58 |
| YS ST | 60.9 | 53.6 | 62.6 | 61.4 | 51 |
| % EL ST | 3.0 | 4.8 | 3.0 | 2.3 | 1.5 |
| K1C S-L | 22.2 | 23.0 | 20.7 | 19.6 | 18 Min. |
| EXCO | EA | EA | EA | EA | EB |
| SCC | NF-25 ksi | NF-25 ksi | NF-25 ksi | NF-25 ksi | NF-35 ksi |

S-1 - 3.0 Cu-1.6 Li-0.3 Mn
S-4 - 2.8 Cu-1.3 Li-1.5 Mg
Over Age = Peak Age + 100 hrs./360 F.

Figure 16:
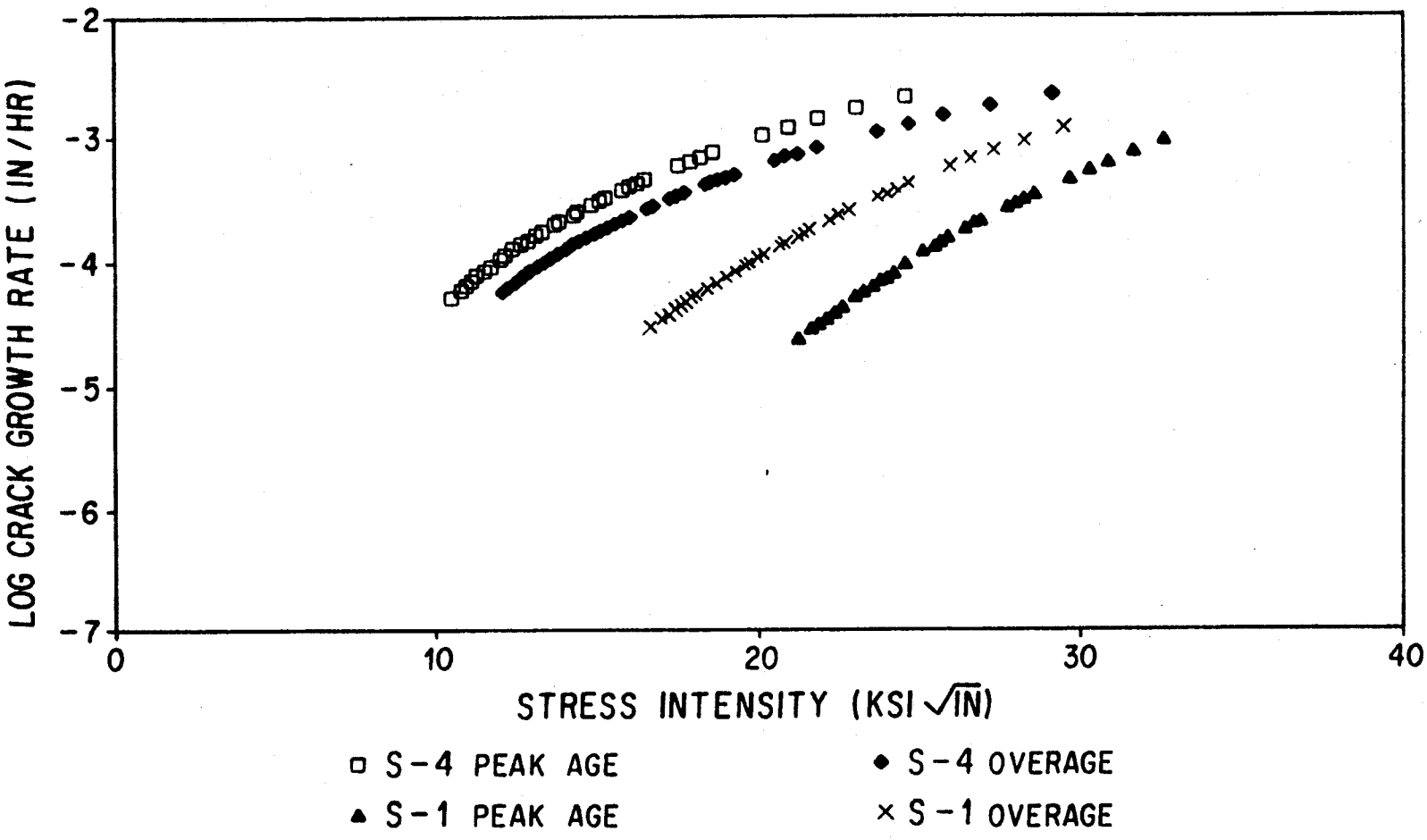
FIG. 16 shows an SCC test on 1.25 inch gauge plate produced from alloys of the present invention.

As had been seen in the 0.6" data, the Mg free alloy had slightly better toughness but poorer thermal stability. Both alloys had EA exfoliation ratings and passed SCC The results of the $K_{ISCC}$ evaluation are summarized in FIG. 16. While the crack velocities have not decreased to $10^{-5}$ in./hr. (which is often taken as an estimate of the "threshold" stress intensity value, $K_{ISCC}$), the data available at this time clearly differentiates between the two alloys. Regardless of age practice, the Mg free alloy (S-1) was more resistant to stress corrosion cracking than the Mg containing alloy (S-4). If the curves are extrapolated to a crack velocity of $10^{-5}$ in./hr., the $K_{ISCC}$ for alloy S-1 is approximately 20 ksi-in$^{\frac{1}{2}}$ in the peak age condition and 13 ksi-in$^{\frac{1}{2}}$ in the overaged condition. This is very comparable to data in the literature for alloy AA2024-T851 which show a $K_{ISCC}$ on the order of 15–20 ksi-in$^{\frac{1}{2}}$ for accelerated tests and atmospheric exposures. An extrapolation of the curves for alloy S-4 indicates a threshold stress intensity of approximately 10 ksi-in$^{\frac{1}{2}}$.

The effect of the overaging treatment (100 hours at 360° F.) on the two alloys was mixed. Overaging had an obvious deleterious effect on the SCC resistance of alloy S-1. For alloy S-4 the effect of the additional thermal exposure was much less pronounced but appears to have the opposite result of slightly improving the SCC resistance of the alloy as compared to the peak age condition.

EXAMPLE 2

From the work described in Example 1, a preferred alloy composition was selected for further study and testing. In this example, the approach was to cast an ingot and roll it to two intermediate gauge plates, verify heat treating practice using small samples in the laboratory, heat treat the plate, verify age practice, then age the plate. The composition of this sample was very similar to sample S-1 from Example 1 and is designated in this Example as S-6.

PROCEDURE

A. Casting

A 12"×45" direct-chill cast ingot was produced with an approximate weight of 9,600 lbs. Composition was as follows:

| | Si | Fe | Cu | Mn | Mg | Cr | Ni | Zn | Ti | Zr | Li | Other | Al |
|---|---|---|---|---|---|---|---|---|---|---|---|---|---|
| Aim | .04 | .06 | 2.82 | 0.30 | — | — | — | — | — | 0.12 | 1.5 | — | bal |
| Max. | .06 | .08 | — | — | .03 | .03 | .03 | .05 | .03 | — | — | .03 | — |
| Actual | .02 | .04 | 2.68 | 0.32 | .01 | ND | ND | ND | .01 | .13 | 1.52 | ** | bal |

*Wet Analysis for Cu, Mg, Zr and Li; others by spectrographic analysis
**B <.001, Ca <.007, Na <.001
ND = Not detected at a detection limit of .01

B. Fabrication

The following practices were applied:

| | |
|---|---|
| Homogenization | Soak 16 hours at 960° F. plus 24 hours at 1000° F. (50° F./hour heating rate). |
| Scalp | 1" per side each roll face<br>2" per side each edge |
| Preheat | Cross-roll to 60" wide<br>Straight roll to 3.6" gauge<br>Shear in two<br>Roll one piece to 1.5" gauge |
| Saw | Rough Cut<br>Sample 20" long F-temper from 1.5" plate for lab work |
| Solution Heat Treat | See C. |
| Quench | Spray, per MIL 6088 |
| Incubate | 4 hour maximum |
| Stretch | 6% |
| Age | See C. |

C. Solution Heat Treating and Aging

Heat treating was carried out on a 6"×15" sample from the 1.5" F-temper plate for one hour at 940° F. and another for one hour at 1000° F., quenched in room temperature water, incubated 2.5–3.5 hours, stretched 5–6%, and aged 16 hours at 350° F. Mechanical properties and stress corrosion were then evaluated. (It should be noted that due to equipment limitations, the W-temper samples were sectioned into longitudinal strips for stretching).

The results, shown in Table 10, did not indicate a preference of heat treating temperature. For plant processing of the 1.5" and 3.6" plate, 950° F. was chosen.

TABLE 10

Effect of Lab Heat Treating Practice on 1.5" S-6 RT70 Plate

| | | S-T | | | S-L | | 32-Day Stress Corrosion SCC: 25 ksi | | SCC:35 ksi | |
|---|---|---|---|---|---|---|---|---|---|---|
| Temp | % Str | UTS | YS | el | $K_{ic}$ | | # Pass | # Fail | # Pass | # Fail |
| 940 | 5 | 68.1 | 58.2 | 6.0 | 26.7<br>27.9 | | 1 | 0 | 1 | 0 |
| 940 | 6 | 66.1 | 58.4 | 5.2 | 23.8 | | 1 | 0 | 1 | 0 |
| 940 | 6 | 66.2<br>66.6 | 57.6<br>58.1 | 5.0<br>7.1 | 25.1 | | 1 | 0 | 2 | 0 |
| 940 | Avg | 66.8 | 58.1 | 5.8 | 25.9 | Total | 3 | 0 | 4 | 0 |
| 1000 | 2.5 | 63.5<br>65.5 | 55.3<br>55.3 | 4.8<br>5.4 | 30 | | NA | NA | 2 | 0 |
| 1000 | Avg | 64.4 | 55.3 | 5.1 | 30 | | | | | |
| 1000 | 5% | 67.0<br>66.1 | 59.1<br>57.6 | 5.2<br>5.2 | 26.6 | | 1 | 0 | 2 | 0 |
| 1000 | 5% | 67.7 | 58.3 | 5.0 | 26.4<br>26.3 | | 1 | 0 | 1 | 0 |

TABLE 10-continued

Effect of Lab Heat Treating Practice on 1.5" S-6 RT70 Plate

| | | | | | | | 32-Day Stress Corrosion | | | |
|---|---|---|---|---|---|---|---|---|---|---|
| | | | | | | | SCC: 25 ksi | | SCC:35 ksi | |
| | | S-T | | | S-L | | # | # | # | # |
| Temp | % Str | UTS | YS | el | $K_{Ic}$ | | Pass | Fail | Pass | Fail |
| 1000 | Avg | 66.9 | 58.3 | 5.1 | 26.4 | Total | 2 | 0 | 3 | 0 |

1) CWQ
2) Stretch varies because the heat treated sample had to be divided for stretching. Likewise, the stress-corrosion data are linked to specific mechanical test samples.
3) Incubation was 2.5-3.5 hours.
4) Age was 16 hrs. at 350° F.
5) % el is by autographic method (in .5").
6) $K_{Ic}$ is valid per ASTM E399 (W=1).
7) SCC per ASTM-G47, S-T, constant strain tensiles, 32-day alternate immersion.
8) -RT70 is a -T851 type temper.

After the plant heat treating, a longitudinal strip was sawed from one edge of the thinner plate and one edge of the thicker plate in order to provide -W51 samples for age practice optimization. The following practices were applied with 40° F./hour heating rates:

1) soak 16 hours/350° F.
2) soak 20 hours/350° F.
3) soak 24 hours/350° F.
4) soak 20 hours/350° F. plus 16 hours/275° F.

The resulting tensile properties are shown in Table 11. (The sample strips sawed from the master plate were not wide enough to allow L-T specimens). Along the length of the master plates, properties were found to be generally uniform. There was some loss in short transverse properties with increase in gauge from 1.5 to 3.6 inches.

S-T tensile properties and S-L toughness were determined on specimens sectioned from the original "toughness samples" from the 3.6" plate. This still allows an analysis of yield strength vs. toughness although the effect of single-step aging time at 350° F. would be indeterminate. The results are shown in Table 12.

TABLE 12

S-T Properties of 3.5" S-6 Plate Plant Heat Treated to -W51 and Lab Aged by Various Practices.

| Age | Location Sample No. | UTS | YS | el | Kg ksi-in ½ | Test Validity |
|---|---|---|---|---|---|---|
| A | CTR-8 | 62.0 | 56.8 | 3.9 | 22.0 | VALID E399 |
| A | CTR-9 | 63.4 | 57.6 | 3.6 | 22.3 | VALID E399 |
| A | CTR-10 | 62.7 | 57.3 | 3.6 | 22.2 | VALID E399 |
| A | CTR-11 | 61.8 | 56.1 | 3.6 | 25.4 | INVALID |
| A | CTR-12 | 62.6 | 57.2 | 2.9 | 22.7 | VALID E399 |
| B | CTR-2S-21 | 63.5 | 57.6 | 2.9 | 23.5 | VALID E399 |
| B | CTR-2S-22 | 63.6 | 57.5 | 3.2 | 23.1 | INVALID |
| A | LE-1 | 63.8 | 57.7 | 3.9 | 23.2 | VALID E399 |
| A | LE-2 | 64.6 | 58.2 | 3.6 | 24.9 | INVALID |
| A | LE-3 | 63.9 | 57.8 | 3.6 | 26.0 | INVALID |
| A | LE-4 | 63.6 | 57.7 | 3.6 | 26.6 | VALID E399 |
| A | LE-5 | 63.8 | 57.5 | 3.6 | 23.9 | VALID E399 |
| A | LE-6 | 63.6 | 57.7 | 3.2 | 21.1 | INVALID |
| A | LE-7 | 64.4 | 57.4 | 3.9 | 23.0 | VALID E399 |
| B | LE-2S-20 | 64.1 | 58.5 | 3.2 | 20.2 | VALID E399 |
| A | TE-13 | 62.8 | 57.0 | 3.6 | 25.1 | VALID E399 |
| A | TE-14 | 63.9 | 57.0 | 4.3 | 22.1 | VALID E399 |
| A | TE-15 | 62.7 | 56.9 | 3.6 | 21.7 | VALID E399 |
| A | TE-16 | 62.8 | 56.9 | 3.2 | 22.8 | VALID E399 |
| A | TE-17 | 62.4 | 56.6 | 3.6 | 21.8 | VALID E399 |
| A | TE-18 | 63.1 | 57.0 | 4.3 | 24.2 | VALID E399 |
| A | TE-19 | 63.0 | 56.7 | 4.3 | 24.4 | VALID E399 |
| B | TE-2S-23 | 63.7 | 57.6 | 3.6 | 22.4 | VALID E399 |

TABLE 11

The Effect of Aging Practice on Mechanical Properties of S-6 Plate Plant Heat Treated to W51 and Lab Aged.

| | | 1.5" Gauge | | | | | | 3.6" Gauge | | | | | |
|---|---|---|---|---|---|---|---|---|---|---|---|---|---|
| Age | | Longitudinal | | | Short Transverse | | | Longitudinal | | | Short Transverse | | |
| Practice | Location | UTS | YS | EL | UTS | YS | EL | UTS | YS | EL | UTS | YS | EL |
| 16/350 | LE | 68.7 | 60.8 | 7.50 | 69.7 | 61.8 | 5.31 | 68.2 | 60.5 | 7.50 | 62.6 | 56.9 | 2.10 |
| | CTR | 72.6 | 64.9 | 10.50 | 70.7 | 63.8 | 5.47 | 66.9 | 59.2 | 8.00 | 63.5 | 56.6 | 3.90 |
| | TE | 67.1 | 59.6 | 12.00 | 70.1 | 61.2 | 3.91 | 67.0 | 59.2 | 7.00 | 62.0 | 56.6 | 3.00 |
| 20/350 | LE | 68.3 | 60.9 | 14.00 | 71.4 | 63.0 | 6.25 | 67.5 | 60.1 | 7.00 | 62.7 | 56.8 | 2.40 |
| | CTR | 68.9 | 61.5 | 13.50 | 70.9 | 61.9 | 6.25 | 68.6 | 60.4 | 7.50 | 62.4 | 60.0 | 2.90 |
| | TE | — | — | — | 72.3 | 63.6 | 6.88 | 65.6 | 58.2 | 6.50 | 60.1 | 55.2 | 2.30 |
| 24/350 | LE | 67.0 | 59.7 | 14.00 | 69.8 | 62.8 | 3.91 | 67.1 | 59.5 | 8.00 | 62.8 | 57.5 | 3.20 |
| | CTR | 68.2 | 60.6 | 13.00 | 69.6 | 63.0 | 4.69 | 68.2 | 60.4 | 7.50 | 62.1 | 56.6 | 2.20 |
| | TE | 66.0 | 58.9 | 14.50 | 69.7 | 62.2 | 8.13 | 66.9 | 58.7 | 7.00 | 60.4 | 55.3 | 2.70 |
| 20/350 | LE | 68.8 | 57.5 | 6.00 | 70.8 | 63.3 | 6.25 | 68.1 | 62.0 | 7.50 | 63.2 | 55.5 | 2.00 |
| plus | CTR | 72.8 | 58.3 | 10.50 | 69.9 | 62.7 | 2.34 | 66.2 | 61.0 | 7.50 | 62.7 | 56.7 | 2.50 |
| 16/275 | TE | — | — | — | 71.1 | 61.9 | 6.25 | 66.4 | 61.2 | 7.50 | 60.3 | 60.7 | 1.90 |

1) Stretchs 5.5-5.9% actual.
2) Strength in ksi, elongation in %. (McCook Data)
3) Longitudinal speciman plane ¼ for 1.5" plate, ¼ for 3.6" plate
4) Specimen particulars as follows:

| Plate Gauge, In. | Orientation | Reduced Dia., In. | Gauge Length, In. |
|---|---|---|---|
| 3.6, 1.5 | L | .500 | 2 |
| 3.6 | 5-1 | .250 | 1 |
| 1.5 | 5-1 | .160 | 0.640 |

5) Location codes relative to conveyor heat treating master plate: LE: leading edge; CTR: center; TE: trailing edge.

TABLE 12-continued

S-T Properties of 3.5" S-6 Plate Plant Heat Treated to -W51 and Lab Aged by Various Practices.

| Age | Location Sample No. | UTS | YS | el | Kg ksi-in ½ | Test Validity |
|---|---|---|---|---|---|---|
| B | TE-2S-24 | 63.6 | 57.5 | 3.2 | 21.9 | VALID E399 |

1) Aging Practice: A-16, 20 or 24 hr/350° F. B-20 hr/350° F. plus 16 hr/275° F.
2) .350" round tensiles, gauge length = 1.4"
3) W = 1 compact tension specimens.
4) Location codes (LE, CTR, TE) same as in Table 2.
5) "Invalid" under Test Validity heading means per ASTM E399 and B645.

Figure 17:
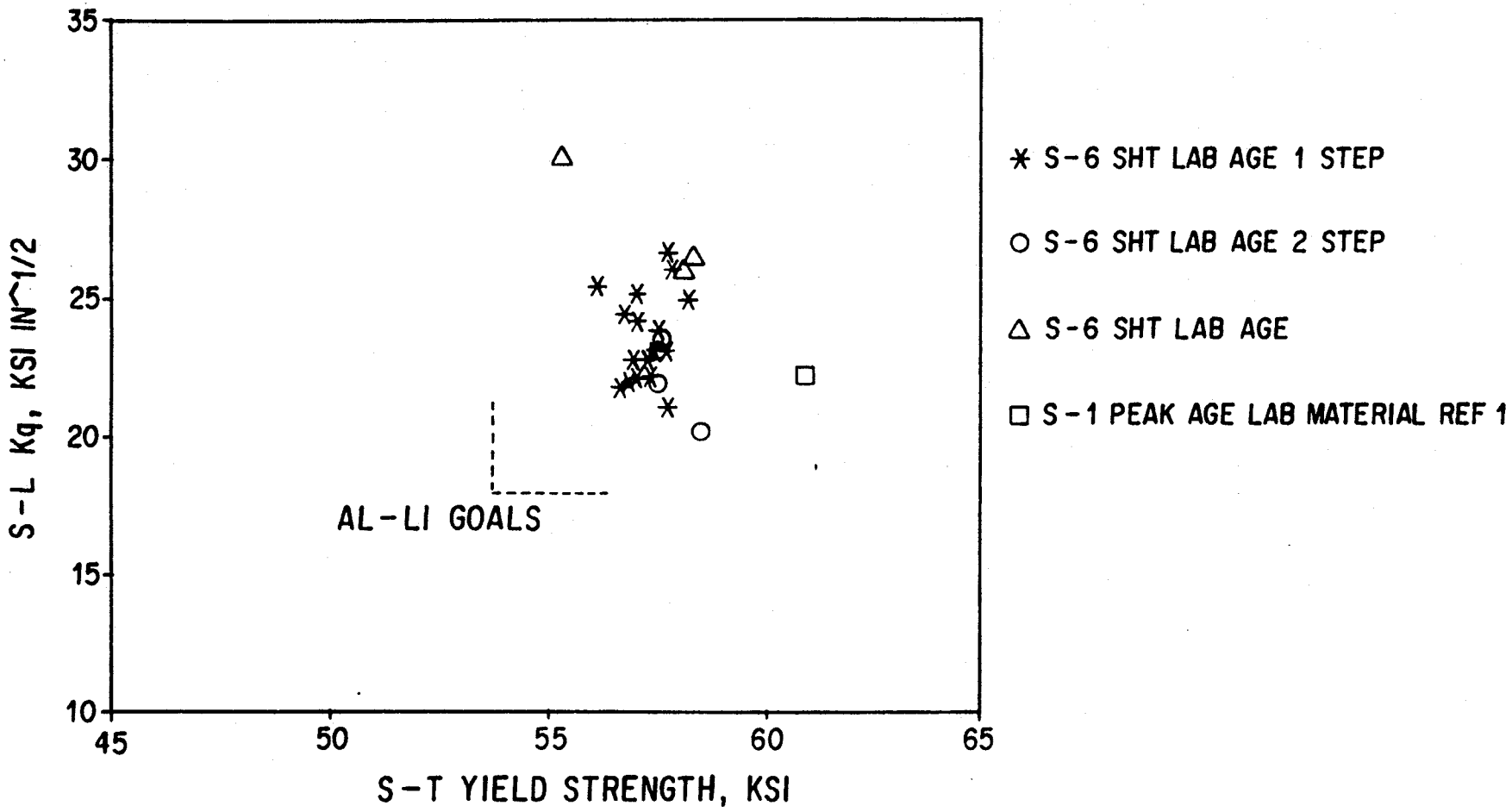
FIG. 17 and FIG. 18 are graphs which show toughness and strength of a specific alloy of the invention.
Figure 18:
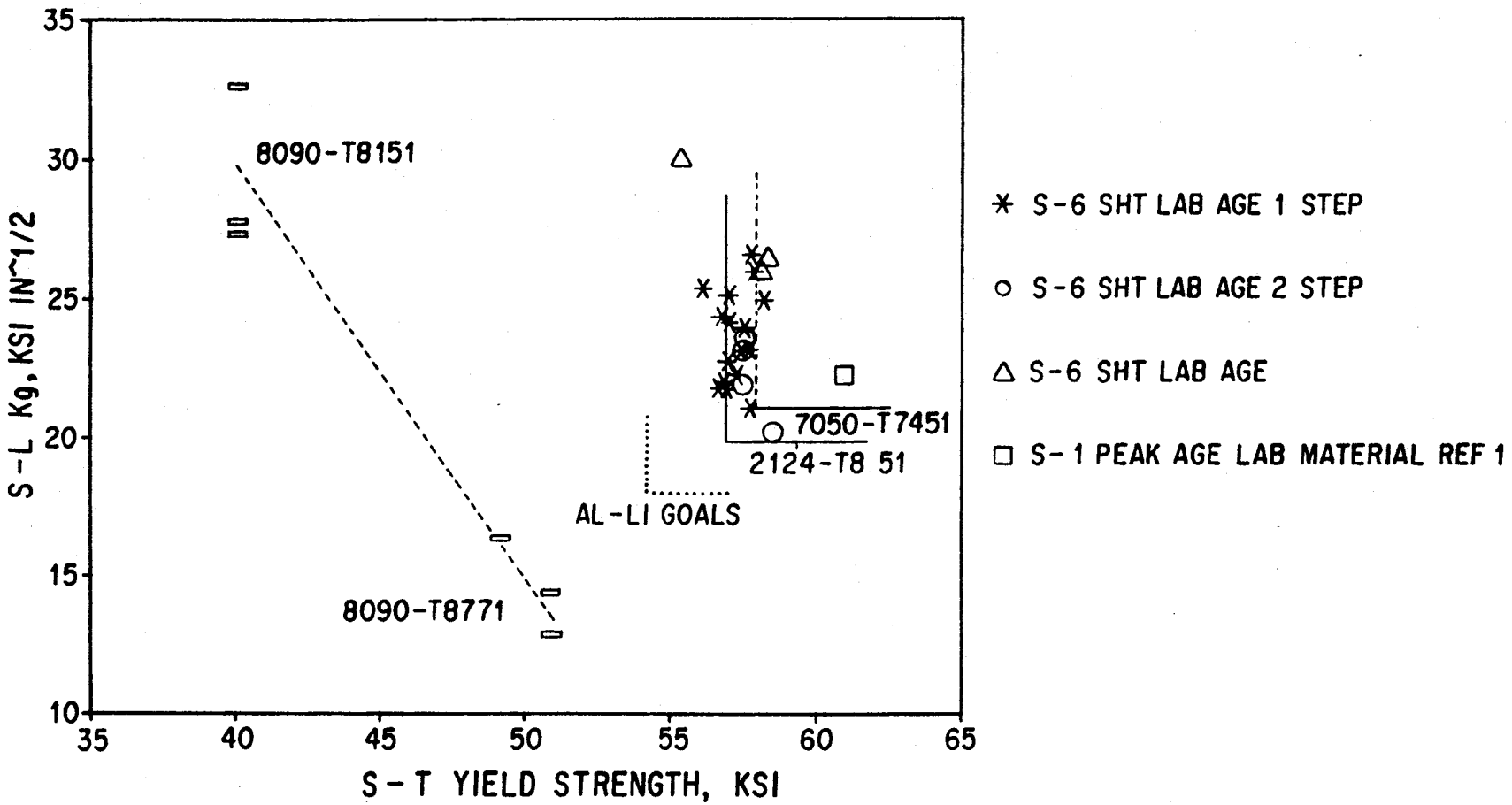

Overall, the $K_q$ values in Table 12 are considered to be good indicators of KIc. As shown in FIG. 17, strength/toughness goals are achievable with S-6. (FIG. 17 includes the data from the heat treat temperature study and the original laboratory-scale For comparison, limits for AA7050-T7451, AA2124-T851 and customer-generated data on alloy AA8090-T8151 and -T8771 have been added, resulting in FIG. 18. S-6 appears to have improved strength/toughness compared with alloy AA8090 based on reported data.

Based on these results, the preferred practice was finalized with the following selections:

| | |
|---|---|
| Solution Heat Treat: | 950° F. |
| Age: | 16 hours at 350° F. (40° F./hour rate) |

RESULTS

Mechanical test release values (single test results) were as follows:

| | S-6 | | | | | |
|---|---|---|---|---|---|---|
| | 3.5" Lot | | | 1.5" Lot | | |
| | UTS | YS | % EL | UTS | YS | % EL |
| LT | 64.6 | 60.9 | 9.0% | 69.8 | 65.7 | 11.0% |
| L | 64.3 | 61.8 | 4.0% | 68.9 | 65.0 | 13.0% |
| ST | 61.5 | 55.7 | 1.7% | 68.9 | 59.1 | 6.4% |

These properties compare favorably with those reported for alloy AA8090 peak aged at 340° F. for 40 hours.

| | 3.5" Plate 8090 | | | 1.75" Plate 8090 | | |
|---|---|---|---|---|---|---|
| | UTS | YS | EL | UTS | YS | EL |
| LT | 66.5 | 61.2 | 5.5 | 70.3 | 63.0 | 6.0 |
| ST | 59.7 | 50.4 | 1.4 | 67.7 | 52.2 | 1.6 |

EXAMPLE 3

Figure 19:
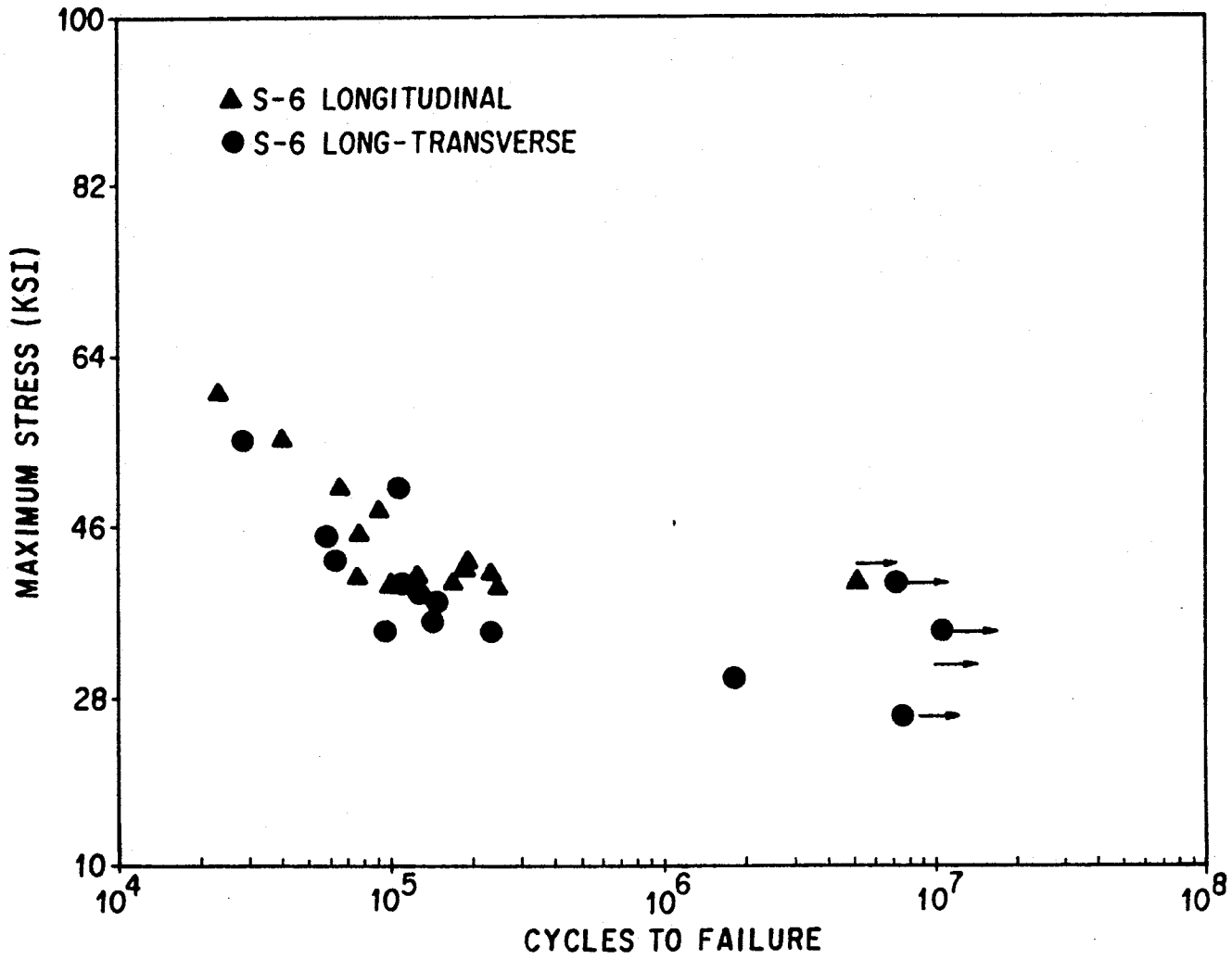
FIG. 19 and FIG. 20 are graphs showing S-N fatigue test results comparing one embodiment of the invention with prior art alloys.
Figure 20:
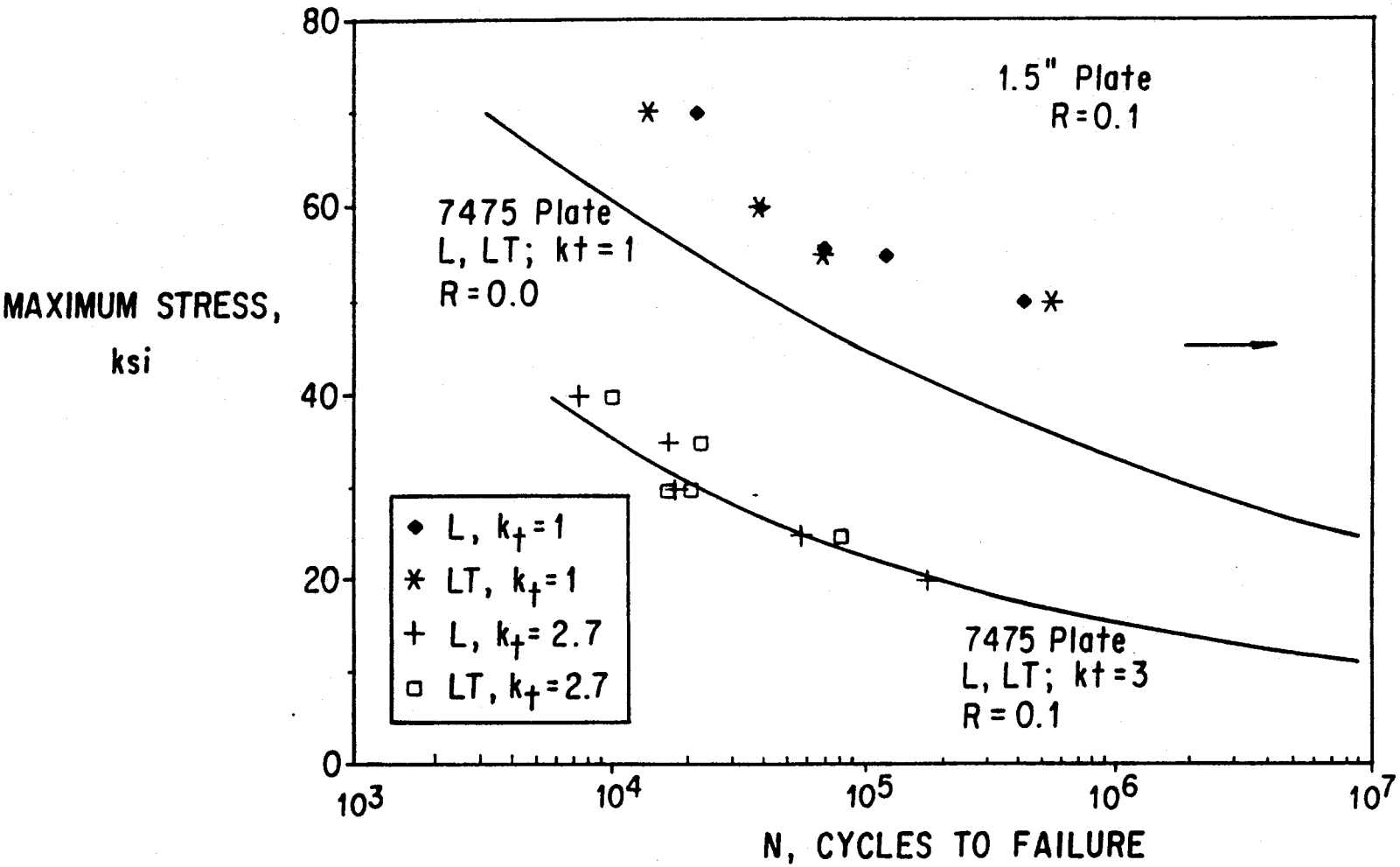

The preferred alloy of the present invention, as described in Example 2 in the form of a plate, was then subjected to strength evaluations set forth in the following tables. Additionally, FIGS. 19 and 20 present comparative test results establishing the surprising S-N fatigue properties possessed by Alloy S-6 of the present invention.

TABLE 13

Compressive Yield Strength of S-6 at Temperature Following Thermal Exposure

| Time of Exposure (hrs.) | Temperature of Exposure (deg. F.) 300 | 350 | 400 |
|---|---|---|---|
| 0.5 | 58.1 ksi | 54.0 ksi | 49.6 ksi |
| 100 | 56.1 ksi | 48.2 ksi | 38.0 ksi |
| 1,000 | 51.3 ksi | 39.3 ksi | Not in Test Matrix |

TABLE 14

Compressive Yield Strength of S-6 at Room Temperature Following Thermal Exposure

| Time of Exposure (hrs.) | Temperature of Exposure (deg. F.) 300 | 350 | 400 |
|---|---|---|---|
| 0.5 | Not in Test Matrix | 61.1 ksi | 61.9 ksi |
| 100 | 61.9 ksi | 55.5 ksi | 47.3 ksi |
| 1,000 | 60.0 ksi | 49.3 ksi | Not in Test Matrix |

TABLE 15

Longitudinal Tensile Properties of S-6 at Temperature Following Thermal Exposure

| Time of Exposure (hrs.) | Temperature of Exposure (deg. F.) 300 Yield, (ksi) | 300 Ultimate, (ksi) | 300 Elongation (%) | 350 Yield, (ksi) | 350 Ultimate, (ksi) | 350 Elongation (%) | 400 Yield, (ksi) | 400 Ultimate, (ksi) | 400 Elongation (%) |
|---|---|---|---|---|---|---|---|---|---|
| 0.5 | 53.2, | 53.2, | 14.5% | 50.2, | 50.2, | 12.5% | 46.8, | 46.8, | 11.75% |
| 100 | 54.4, | 54.9, | 11.25% | 45.7, | 45.7, | 14.75% | 37.1, | 37.7, | 18.25% |
| 1,000 | 50.7, | 51.3, | 13.5% | 39.1, | 40.3, | 15% | | Not in Test Matrix | |

TABLE 16

Longitudinal Tensile Properties of S-6 at Room Temperature Following Thermal Exposure

| Time of Exposure (hrs.) | Temperature of Exposure (deg. F.) 300 Yield, (ksi) | 300 Ultimate, (ksi) | 300 Elongation (%) | 350 Yield, (ksi) | 350 Ultimate, (ksi) | 350 Elongation (%) | 400 Yield, (ksi) | 400 Ultimate, (ksi) | 400 Elongation (%) |
|---|---|---|---|---|---|---|---|---|---|
| 0.5 | | Not in Test Matrix | | 60.4, | 65.9, | 7.75% | 60.55, | 65.5, | 8.25% |
| 100 | 60.8, | 66.4, | 7.5% | 55.0, | 62.1, | 8.5% | 46.9, | 56.0, | 9.5% |
| 1,000 | 57.8, | 64.4, | 6.75% | 47.3, | 56.8, | 8.5% | | Not in Test Matrix | |

TABLE 17

Tensile Properties and Fracture Toughness of 3.6" S-6 Plate at Room Temperature after 100 hrs. at 250° F.

| Tensile Direction | Yield Strength (ksi) | Ultimate Tensile Strength (ksi) | Elongation (%) |
|---|---|---|---|
| LT | 61.1 | 66.6 | 5.5 |
| ST | 56.2 | 60.7 | 2.0 |

| Fracture Toughness Direction | $K_{1c}$ (ksi · $\sqrt{in}$) |
|---|---|
| L-T | 33.6 |
| S-L | 24.7 |

TABLE 18

Young's Modulus of 3.6" S-6 Plate (at temperature following a 0.5 hr. soak)

| Temperature (°F.) | Tensile Modulus (msi) | Compressive Modulus (msi) |
|---|---|---|
| Room | 10.35 | 10.9 |
| 300 | 9.45 | 10.05 |
| 350 | 9.55 | 10.15 |
| 400 | 8.95 | 10.05 |

TABLE 19

Directionally in the Tensile Properties of 3.6" S-6 Plate

| Orientation w.r.t. Rolling Direction | Yield Strength (ksi) | Ultimate Tensile Strength (ksi) | Elongation (%) |
|---|---|---|---|
| 15° | 60.4 | 66.4 | 7.5 |
| 30° | 59.3 | 65.4 | 7.0 |
| 60° | 59.1 | 64.8 | 5.0 |

With one preferred embodiment of the invention, as embodied in Alloys S-1 and S-6, the magnesium level is between 0 and 0.25 percent and the manganese level is between 0.1 and 1.0 percent, preferably between 0.2 and 0.6 percent. The lithium level is between 1.2 and 1.8 percent and the copper level is between 2.5 and 3.2 percent. Silicon and iron are present as impurities and chromium, titanium, zinc and zirconium may be present at the levels normally experienced with present commercially available aluminum lithium alloys. This embodiment is intended for use in applications requiring exfoliation and SCC resistance, good fracture toughness, and good fatigue crack growth resistance, with low density. Also, with this embodiment, the intentional addition of manganese enhances thermal stability.

With another preferred embodiment of the invention, as embodied in Alloys S-3 and S-4, the magnesium level is between 0.8 and 1.8 percent, the lithium level is between 1.2 and 1.8 percent, and the copper level is between 2.5 and 3.2 percent. The alloy also includes at least one grain refiner selected from the group consisting of chromium, manganese and zirconium. Silicon and iron are present as impurities and titanium and zinc may be present at the levels normally experienced with present commercially available aluminum lithium alloys. This embodiment has surprisingly high thermal stability, that is increased service life when exposed to elevated temperature operating conditions. The embodiment also provides a surprising and unexpected combination of low density, high strength, SCC resistance and toughness.

The invention has been described herein with reference to certain preferred embodiments; however, as obvious variations thereon will be become apparent to those skilled in the art, the invention is not to be considered as limited thereto.

What is claimed is:

1. An aluminum based alloy having an improved combination of characteristics including low density, high strength, high corrosion resistance, an exfoliation resistance rating of at least EA and high fracture toughness, which consists essentially of the following composition: 2.80 to 3.30 weight percent copper, 0.0 to 0.50 weight percent manganese, 1.30 to 1.65 weight percent lithium, 0.0 to 1.80 weight percent magnesium, 0.0 to 0.04 weight percent zinc as an impurity and from 0.0 to 1.5 weight percent of grain refinement elements selected from the group consisting of zirconium, titanium and chromium.

2. An alloy according to claim 1 wherein the copper, manganese, lithium and magnesium consist essentially of: 2.80–3.20 wt. % copper, 0.10–0.30 wt % manganese, 1.40–1.60 wt % lithium, and 0.0–1.5 wt % magnesium.

3. An ingot formed from an aluminum based alloy having an improved combination or properties including low density, high strength, high corrosion resistance, an exfoliation resistance rating of at least EA and high fracture toughness, which consists essentially of the following composition: 2.80 to 3.30 weight percent copper, 0.0 to 0.50 weight percent manganese, 1.30 to 1.65 weight percent lithium, 0.0 to 1.80 weight percent magnesium, 0.0 to 0.04 weight percent zinc as an impurity and from 0.0 to 1.5 weight percent of grain refinement elements selected from the group consisting of zirconium, titanium and chromium.

4. An ingot according to claim 3 wherein the copper, manganese, lithium and magnesium consist essentially of: 2.80–3.20 wt. % copper, 0.10–0.30 wt % manganese, 1.40–1.60 wt % lithium, and 0.0–1.0 wt % magnesium.

5. An aluminum plate or sheet formed from an aluminum based alloy having an improve combination of properties including low density, high strength, high corrosion resistance, an exfoliation resistance rating of at least EA and high fracture toughness which consists essentially of the following composition: 2.8 to 3.3 weight percent copper, 0.0 to 0.50 weight percent manganese, 1.30 to 1.65 weight percent lithium, 0.0 to 1.8 weight percent magnesium, 0.0 to 0.04 weight percent zinc as an impurity and from 0.0 to 1.5 weight percent of grain refinement elements selected from the group consisting of zirconium, titanium and chromium, said plate or sheet exhibiting a UTS of 70.0–75.0 ksi, a YS of 63.0–70.0 ksi and a % elongation of 7.0–11.5 in the transverse direction and a UTS of 68.0–74.0 ksi, a YS of 64.0–71.5 ksi and a % elongation of 6.0–10.5 in the longitudinal direction.

6. An aluminum plate, sheet or extrusion according to claim 5 wherein the copper, manganese, lithium and magnesium consist essentially of: 2.80–3.20 wt. % copper, 0.10–0.30 wt % manganese, 1.40–1.60 wt % lithium, and 0.0–1.0 wt % magnesium.

7. An aluminum based alloy having an improved combination of characteristics including low density, high strength, high corrosion resistance, an exfoliation resistance rating of at least EA and high fracture toughness which consists essentially of the following composition: 2.80 to 3.2 weight percent copper, 0.10 to 1.00 weight percent manganese, 1.20 to 1.80 weight percent lithium, 0.0 to 0.25 weight percent magnesium, 0.0 to 0.04 weight percent zinc as an impurity and from 0.0 to 1.5 weight percent of grain refinement elements selected from the group consisting of zirconium, titanium and chromium, and containing silicon and iron as impurities, said alloy having good SCC resistance, good fracture toughness, good fatigue crack growth resistance and enhanced thermal stability.

8. An alloy according to claim 7 wherein the manganese, lithium and magnesium consist essentially of: 0.10–0.80 wt % manganese, 1.20–1.60 wt % lithium, and 0.0–0.25 wt % magnesium.

9. An ingot formed from an aluminum based alloy of claim 7.

10. An aluminum plate, sheet or extrusion formed from an aluminum based alloy of claim 7.

11. An aluminum based alloy having an improved combination of characteristics including low density, high strength, SCC resistance, an exfoliation resistance rating of at least EA and high fracture toughness, which consists essentially of the following composition: 2.80 to 3.2 weight percent copper, 0.0 to 0.50 weight percent manganese, 1.20 to 1.80 weight percent lithium, 0.8 to 1.80 weight percent magnesium, 0.0 to 0.04 weight percent zinc as an impurity and from 0.0 to 1.5 weight percent of grain refinement elements selected from the group consisting of zirconium, titanium, and chromium, silicon and iron being optionally present as impurities, said alloy having high thermal stability.

12. An ingot formed from the aluminum based alloy of claim 11.

13. An aluminum plate, sheet or extrusion formed from an aluminum based alloy of claim 11.

14. An aerospace or aircraft component produced from the alloy of claim 1.

15. An aerospace or aircraft component produced from the alloy of claim 2.

16. An aerospace or aircraft component formed from the ingot of claim 3.

17. An aerospace or aircraft component formed from the ingot of claim 4.

18. An aerospace or aircraft component formed from the sheet or plate of claim 5.

19. An aerospace or aircraft component formed from the sheet or plate of claim 6.

20. An aerospace or aircraft component formed from the alloy of claim 7.

21. An aerospace or aircraft component formed from the ingot of claim 9.

22. An aerospace or aircraft component formed from the sheet or plate of claim 10.

23. An aerospace or aircraft component produced the alloy of claim 11.

24. An aerospace or aircraft component formed from the ingot of claim 12.

25. An aerospace or aircraft component formed from the plate or sheet of claim 13.

26. The alloy according to claim 1 wherein the composition contains about 3.00 weight percent copper, about 1.60 weight percent lithium, and about 0.30 weight percent manganese.

27. The alloy according to claim 1 wherein the composition contains about 2.8 weight percent copper, about 1.30 weight percent lithium, and about 1.50 weight percent magnesium.

* * * * *